US006640567B2

(12) United States Patent
Kim et al.

(10) Patent No.: US 6,640,567 B2
(45) Date of Patent: Nov. 4, 2003

(54) AIR CONDITIONING SYSTEM WITH LOW COMPRESSION LOAD

(75) Inventors: Young Ho Kim, Pusan (KR); Shin Hee Ryu, Seoul (KR)

(73) Assignee: Sun Gelm Kim (KR)

( * ) Notice: Subject to any disclaimer, the term of this patent is extended or adjusted under 35 U.S.C. 154(b) by 0 days.

(21) Appl. No.: 09/875,782

(22) Filed: Jun. 6, 2001

(65) Prior Publication Data

US 2002/0035840 A1 Mar. 28, 2002

(30) Foreign Application Priority Data

Sep. 25, 2000 (KR) ..... 2000-0056279

(51) Int. Cl.[7] ..... F25B 5/00; F25B 41/00
(52) U.S. Cl. ..... 62/199; 62/513
(58) Field of Search ..... 62/199, 513, 498, 62/47

(56) References Cited

U.S. PATENT DOCUMENTS 2,386,198 A * 10/1945 Dodson ..... 62/513
3,423,954 A * 1/1969 Harnish et al. ..... 62/513
4,809,521 A * 3/1989 Mokadam ..... 62/498
4,959,972 A * 10/1990 Lowes ..... 62/200
6,058,729 A * 5/2000 Lifson et al. ..... 62/217
6,138,467 A * 10/2000 Lifson et al. ..... 62/217
6,189,335 B1 * 2/2001 Ebara et al. ..... 62/510
6,385,981 B1 * 5/2002 Vaisman ..... 62/196.3

* cited by examiner

*Primary Examiner*—William C. Doerrler
(74) *Attorney, Agent, or Firm*—Webb Ziesenheim Logsdon Orkin & Hanson, P.C.

(57) ABSTRACT

The object of this invention is to provide an air conditioning system with low compression load. This air conditioning system consists of an expansion unit for adiabatically expanding refrigerant, an indoor unit having a heat exchanger, a compressor for adiabatically compressing the refrigerant, and an outdoor unit having a heat exchanger, and circulates refrigerant through the compressor, outdoor unit, expansion unit, and indoor unit to heat or cool a target area using the phase change of the refrigerant. In an embodiment, the air conditioning system (100) is designed such that condensed refrigerant from the indoor unit (120) or the outdoor unit (140) passes through a sub-evaporating unit (150) prior to flowing into the expansion unit (110), with the refrigerant from the sub-evaporating unit (150) partially flowing into a sub-expansion unit (171) to be adiabatically expanded to become low temperature, low pressure bypassed refrigerant prior to flowing into the compressor (130) through the sub-evaporating unit (150).

8 Claims, 12 Drawing Sheets

AIR CONDITIONING SYSTEM WITH LOW COMPRESSION LOAD

TECHNICAL FIELD

The present invention relates, in general, to an air conditioning system with low compression load and, more particularly, to an air conditioning system designed to preferably reduce the compression load of its compressor by reducing the temperature of refrigerant flowing into the compressor.

BACKGROUND ART

In the prior art, an air conditioning system, designed to perform its heating or cooling function by taking advantage of the phase change of the refrigerant to dissipate or absorb heat to or from air of a target room using the phase change of the refrigerant, has been proposed and widely used. In a heating or cooling operation, the air conditioning system repeatedly carries out a refrigerating cycle where refrigerant is sequentially subjected to a compression process, a condensation process, an expansion process, and an evaporation process prior to being returned to the compression process.

The conventional air conditioning systems have been classified into three types: a cooling system designed to cool a target room, a heating system designed to heat a target room, and a heating/cooling system designed to heat or cool a target room in accordance with its operational mode selected by a user.

In the conventional heating systems or the conventional cooling systems, refrigerant flows through a fixed passage. However, the heating/cooling system is designed such that refrigerant flows through a heating mode passage or a cooling mode passage in accordance with its operational mode selected by a user.

Each of the conventional heating systems, cooling systems and heating/cooling systems comprises an indoor unit, an outdoor unit, a compressor, and an expansion unit. The indoor unit is installed within a room, while the outdoor unit is installed outside the room. The compressor adiabatically compresses low temperature, low pressure gas refrigerant to discharge high temperature, high pressure gas refrigerant. The expansion unit adiabatically expands high temperature, high pressure gas refrigerant to discharge low temperature, low pressure liquid refrigerant. The indoor unit, outdoor unit, compressor, and expansion unit are connected together by a refrigerant pipeline to allow refrigerant to flow through them during an operation of the air conditioning system. A plurality of sensors are installed at predetermined positions of the air conditioning system to sense the temperature and pressure of the refrigerant. The operation of the air conditioning system is controlled by a controller, which controls power supply for the electrically operable elements, such as the compressor, the sensors, etc., in addition to controlling the operation of the elements in response to signals output from the sensors. Particularly, the heating/cooling system has a plurality of control valves, which are used for changing the refrigerant flowing passage in accordance with a selected operational mode of the system.

The conventional cooling system or the conventional heating/cooling system is operated as follows when it is desired to cool a target room using the system.

At the indoor unit, low temperature, low pressure liquid refrigerant absorbs heat from air inside the target room prior to being discharged to the compressor. At the compressor, the low temperature, low pressure gas refrigerant from the indoor unit is compressed to become high temperature, high pressure gas refrigerant prior to being discharged to the outdoor unit. At the outdoor unit, the high temperature, high pressure gas refrigerant from the compressor dissipates heat to atmospheric air, thus being condensed to become high temperature, high pressure liquid refrigerant prior to being discharged to the expansion unit. The expansion unit adiabatically expands the high temperature, high pressure liquid refrigerant from the outdoor unit to discharge low temperature, low pressure liquid refrigerant to the indoor unit. The system thus finishes one operation cycle.

The conventional heating system or the conventional heating/cooling system is operated as follows when it is desired to heat a target room using the system.

At the indoor unit, high temperature, high pressure gas refrigerant dissipates heat to air inside the target room, thus being condensed to become high temperature, high pressure liquid refrigerant prior to being discharged to the expansion unit. The expansion unit adiabatically expands the high temperature, high pressure liquid refrigerant from the indoor unit to discharge low temperature, low pressure liquid refrigerant to the outdoor unit. At the outdoor unit, the low temperature, low pressure liquid refrigerant from the expansion unit absorbs heat from atmospheric air, thus being evaporated to become low temperature, low pressure gas refrigerant prior to being discharged to the compressor. At the compressor, the low temperature, low pressure gas refrigerant from the outdoor unit is compressed to become high temperature, high pressure gas refrigerant prior to being discharged to the indoor unit. The system thus finishes one operation cycle.

In such conventional air conditioning systems, it is typical to control the temperature of inlet refrigerant of the compressor such that the temperature is increased to slightly exceed the saturation point of the refrigerant, where the refrigerant includes both a gas phase portion and a liquid phase portion. When the temperature of the inlet refrigerant of the compressor is increased as described above, the inlet refrigerant is converted entirely to gas refrigerant. When refrigerant including a liquid phase portion flows into the compressor, the refrigerant may undesirably deteriorate the refrigerant compressing capability of the compressor, in addition to damaging or breaking the parts of the compressor.

When the temperature of inlet refrigerant of the compressor is increased excessively to exceed the saturation point of the refrigerant, the inlet refrigerant may thermally damage the parts of the compressor to cause a thermal deterioration of the parts and undesirably shorten the expected life span of the compressor, in addition to remarkably reducing the compression efficiency of the compressor.

However, such conventional air conditioning systems do not include any means for appropriately controlling the conditions of inlet refrigerant of their compressors, and so the inlet refrigerant of the compressor undesirably has a temperature excessively exceeding the saturation point of the refrigerant, where the refrigerant includes both a gas phase portion and a liquid phase portion.

The compressor's inlet refrigerant having such an excessively increased temperature thermally damages the parts of the compressor to cause a thermal deterioration of the parts and undesirably shorten the expected life span of the compressor, and forces the owner of the air conditioning system to waste time and pay money for repairing the air conditioning system.

The inlet refrigerant having such an excessively increased temperature also undesirably causes the outlet refrigerant from the compressor to have excessively high temperature or excessively low pressure.

When the outlet refrigerant from the compressor has an excessively high temperature, it is necessary for the refrigerant to dissipate an excessively large quantity of heat to surrounding air during a condensation process. When the outlet refrigerant from the compressor has an excessively low pressure, it is almost impossible to desirably condense the refrigerant during the condensation process since the temperature of the refrigerant is too low. Either of the two cases undesirably reduces the heat and/or cooling effect of the air conditioning system.

DISCLOSURE OF THE INVENTION

Accordingly, the present invention has been made keeping in mind the above problems occurring in the prior art, and an object of the present invention is to provide an air conditioning system, which is designed to prevent the temperature of the inlet refrigerant of its compressor from being increased excessively to exceed the saturation point of the refrigerant with both a gas phase portion and a liquid phase portion of the refrigerant, and which thus preferably reduces the compression load of the compressor.

Another object of the present invention is to provide an air conditioning system, which reduces the compression load of its compressor, thus being free from a reduction in its heating and/or cooling efficiency.

A further object of the present invention is to provide an air conditioning system, which reduces the compression load of its compressor, thus being free from a thermal deterioration of the compressor's parts or a reduction in the expected life span of the compressor.

In order to accomplish the above objects, the primary embodiment of the present invention provides an air conditioning system designed such that the condensed refrigerant from the indoor unit or the outdoor unit passes through a heat exchanging, sub-evaporating unit prior to flowing into the expansion unit, with the refrigerant from the sub-evaporating unit partially flowing into a sub-expansion unit to be adiabatically expanded to become low temperature, low pressure bypassed refrigerant prior to flowing into the compressor through the sub-evaporating unit.

The second embodiment of the present invention provides an air conditioning system designed such that the condensed refrigerant from the indoor unit or the outdoor unit passes through a heat exchanging, sub-evaporating unit prior to flowing into the expansion unit, with the refrigerant from the sub-evaporating unit partially flowing into a sub-expansion unit to be adiabatically expanded to become low temperature, low pressure bypassed refrigerant, and both the bypassed refrigerant flowing from the sub-expansion unit and the refrigerant flowing from the outdoor unit or the indoor unit commonly passing through the sub-evaporating unit prior to flowing into the compressor.

The third embodiment of the present invention provides an air conditioning system designed such that the condensed refrigerant from the indoor unit or the outdoor unit passes through a heat exchanging, sub-evaporating unit prior to flowing into the expansion unit, with the refrigerant from the sub-evaporating unit partially flowing into a sub-expansion unit to be adiabatically expanded to become low temperature, low pressure bypassed refrigerant, and both the bypassed refrigerant flowing from the sub-expansion unit and passing through the sub-evaporating unit and the refrigerant flowing from the outdoor unit or the indoor unit and passing through the expansion unit commonly flowing into the compressor.

The fourth embodiment of the present invention provides an air conditioning system designed such that the condensed refrigerant from the indoor unit or the outdoor unit passes through a heat exchanging, sub-evaporating unit prior to flowing into the expansion unit, with the refrigerant from the sub-evaporating unit partially flowing into a sub-expansion unit to be adiabatically expanded to become low temperature, low pressure bypassed refrigerant, and both the bypassed refrigerant flowing from the sub-expansion unit and the refrigerant flowing from the outdoor unit or the indoor unit and passing through the expansion unit commonly passing through the sub-evaporating unit prior to flowing into the compressor.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
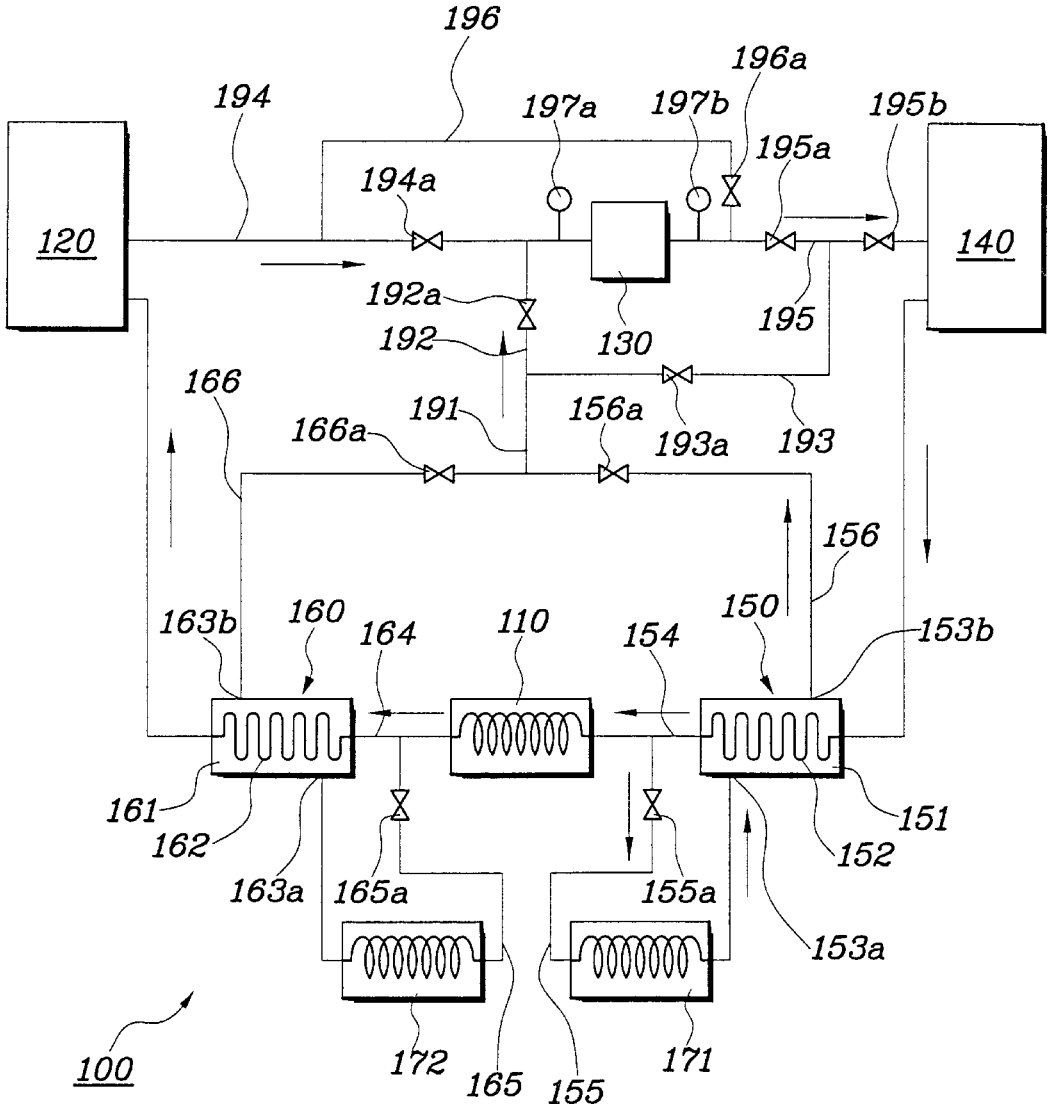
FIG. 1 is a block diagram, showing the refrigerant flow of a low compression load-type air conditioning system designed to perform a heating/cooling operation in accordance with the primary embodiment of the present invention when the system is operated in a cooling mode.

Reference now should be made to the drawings, in which the same reference numerals are used throughout the different drawings to designate the same or similar components.

Figure 2:
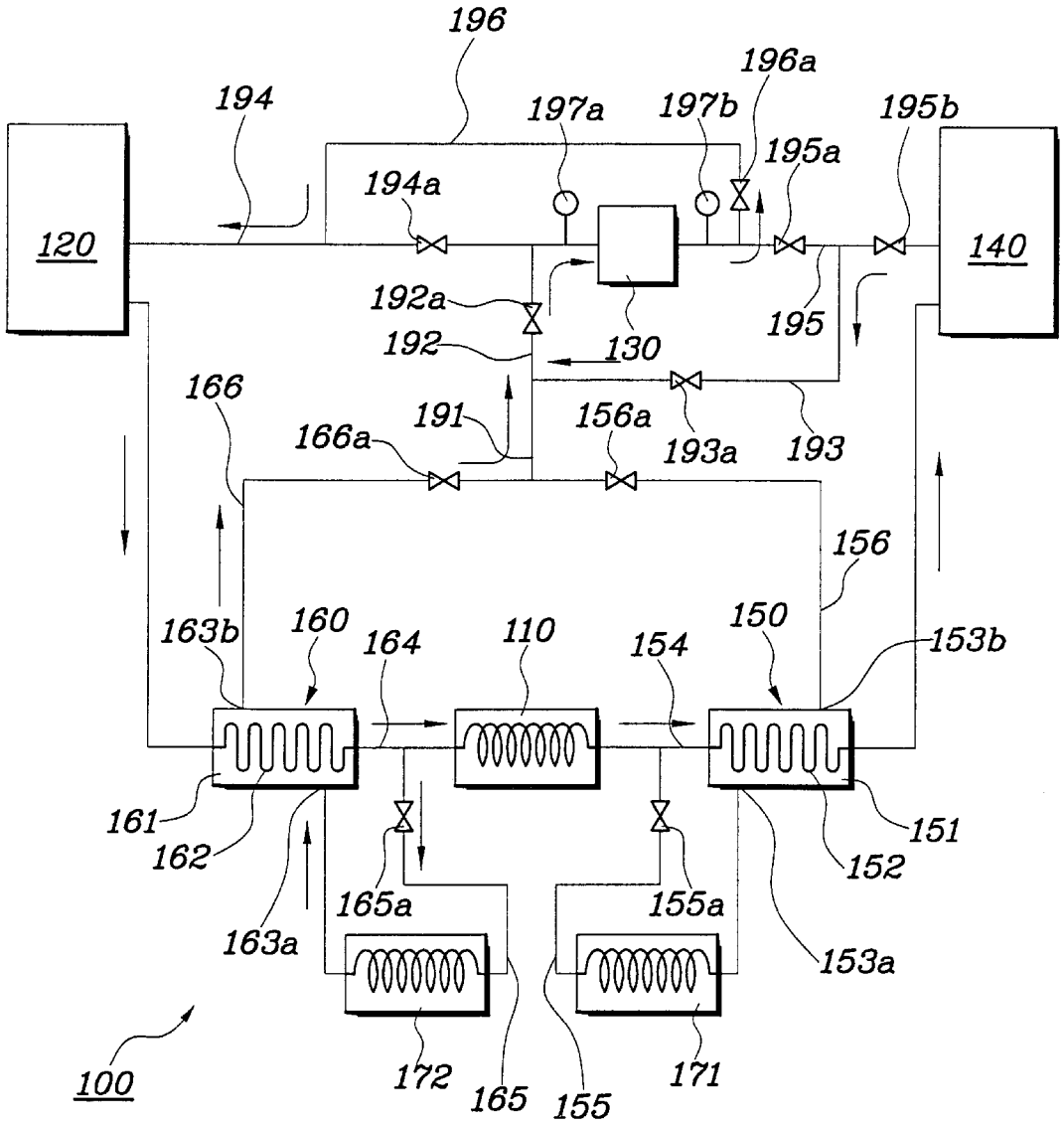
FIG. 2 is a block diagram, showing the refrigerant flow of the low compression load-type air conditioning system according to the primary embodiment of this invention when the system is operated in a heating mode.

FIGS. 1 and 2 are block diagrams of an air conditioning system with low compression load in accordance with the primary embodiment of the present invention. FIG. 1 shows the refrigerant flow of the system in a cooling mode. FIG. 2 shows the refrigerant flow of the system in a heating mode.

As shown in the drawings, the air conditioning system 100 according to the primary embodiment comprises an expansion unit 110, an indoor unit 120, a compressor 130, and an outdoor unit 140. The expansion unit 110 adiabatically expands high pressure inlet refrigerant prior to discharging low pressure refrigerant. The indoor unit 120 has a heat exchanger, and is installed inside a target room. The compressor 130 adiabatically compresses low pressure inlet refrigerant prior to discharging high pressure refrigerant. The outdoor unit 140 has a heat exchanger, and is installed outside the target room. The expansion unit 110, indoor unit 120, compressor 130 and outdoor unit 140 are connected together by a pipeline to form a refrigerant passage of the system.

A first sub-evaporating unit 150 is mounted to the refrigerant pipeline between the expansion unit 110 and the outdoor unit 140, while a second sub-evaporating unit 160 is mounted to the refrigerant pipeline between the expansion unit 110 and the indoor unit 120. Each of the first and second sub-evaporating units 150 and 160 has a housing 151 or 161 receiving a heat exchanger 152 or 162 therein. The first heat exchanger 152 forms a refrigerant passage connecting the expansion unit 110 to the outdoor unit 140. The second heat exchanger 162 forms a refrigerant passage connecting the expansion unit 110 to the indoor unit 120. The two housings 151 and 161 each have a refrigerant inlet port 153*a* or 163*a* and a refrigerant outlet port 153*b* or 163*b*. The refrigerant flowing into each of the housings 151 and 161 through an associated refrigerant inlet port 153*a* or 163*a* comes into contact with the external surface of an associated heat exchanger 152 or 162 while moving through a predetermined passage within the housing 151 or 161 prior to being discharged through an associated refrigerant outlet port 153*b* or 163*b*.

A first bypass pipe 155 branches from the first connection pipe 154 extending from the expansion unit 110 to the first sub-evaporating unit 150. A second bypass pipe 165 branches from the second connection pipe 164 extending from the expansion unit 110 to the second sub-evaporating unit 160. The first and second bypass pipes 155 and 165 each have a flow control valve 155*a* or 165*a*, and respectively extend to one ends of first and second sub-expansion units 171 and 172. The other ends of first and second sub-expansion units 171 and 172 are respectively connected to the refrigerant inlet ports 153*a* and 163*a* of the first and second sub-evaporating units 150 and 160.

The refrigerant outlet ports 153*b* and 163*b* of the first and second sub-evaporating units 150 and 160 are connected to one ends of first and second low temperature refrigerant outlet pipes 156 and 166. The other ends of the first and second low temperature refrigerant outlet pipes 156 and 166 are connected to each other at one end of a low temperature refrigerant supply pipe 191. The other end of a low temperature refrigerant supply pipe 191 is connected to first and second refrigerant pipes 192 and 193. The first refrigerant pipe 192 is connected to a first compressor pipe 194 extending between the indoor unit 120 and the compressor 130, while the second refrigerant pipe 193 is connected to a second compressor pipe 195 extending between the outdoor unit 140 and the compressor 130. Each of the first and second low temperature refrigerant outlet pipes 156 and 166 and the first and second refrigerant pipes 192 and 193 is provided with a flow control valve 156*a*, 166*a*, 192*a* or 193*a*.

Two flow control valves 195*a* and 195*b* are mounted to the second compressor pipe 195 at opposite positions of the joint of the second compressor pipe 195 and the second refrigerant pipe 193. Of two flow control valves 195*a* and 195*b*, the first one 195*a* controls the refrigerant flow toward the compressor 130, while the second one 195*b* controls the refrigerant flow toward the outdoor unit 140.

A flow control valve 194*a* is mounted to the first compressor pipe 194 at a position between the indoor unit 120 and the joint of the first compressor pipe 194 and the first refrigerant pipe 192. The first and second compressor pipes 194 and 195 are connected to each other by a connection pipe 196 having a flow control valve 196*a*. One end of the connection pipe 196 is connected to the first compressor pipe 194 at a position between the flow control valve 194*a* and the indoor unit 120, while the other end of the connection pipe 196 is connected to the second compressor pipe 195 at a position between the flow control valve 195*a* and the compressor 130.

The first and second compressor pipes 194 and 195, connected to the refrigerant inlet and outlet ports of the compressor 130, are each preferably provided with a pressure gauge 197*a* or 197*b* for sensing pressure of inlet or outlet refrigerant of the compressor 130.

Figure 3:
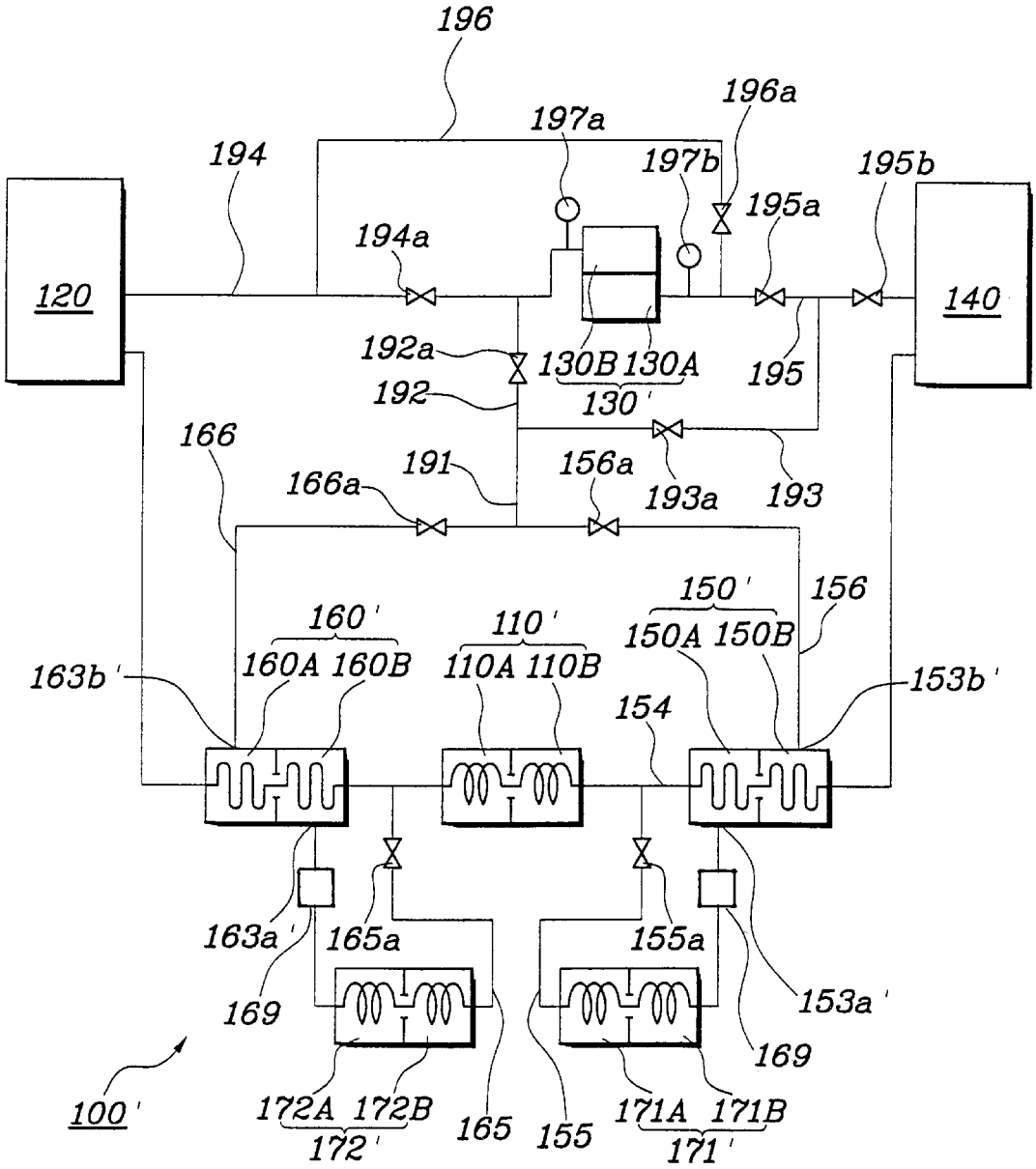
FIG. 3 is a block diagram of a low compression load-type air conditioning system in accordance with a modification of the primary embodiment of this invention.

FIG. 3 is a block diagram of an air conditioning system in accordance with a modification of the primary embodiment of this invention.

As shown in the drawing, the construction and refrigerant flowing passage of the air conditioning system 100' according to the modification is similar to those of the air conditioning system 100 according to the primary embodiment. Therefore, the following description of the air conditioning system 100' is only to describe the construction and refrigerant flowing passage different from those of the air conditioning system 100.

The air conditioning system 100' according to the modification has an expansion unit assembly 110', which comprises two or more expansion units 110A and 110B arranged on the refrigerant pipeline of the air conditioning system 100' in a parallel arrangement or a series arrangement. In addition, the system 100' has a compressor assembly 130', which comprises two or more compressors 130A and 130B arranged on the refrigerant pipeline of the system 100' in a parallel arrangement or a series arrangement. The system 100' also has first and second sub-evaporating unit assemblies 150' and 160', each of which comprises two or more sub-evaporating units 150A and 150B, 160A and 160B arranged on the refrigerant pipeline of the system 100' in a parallel arrangement or a series arrangement. In addition, the system 100' has first and second sub-expansion unit assemblies 171' and 172', each of which comprises two or more sub-expansion units 171A and 171B, 172A and 172B arranged on the refrigerant pipeline of the system 100' in a parallel arrangement or a series arrangement.

The sub-evaporating unit 150B of the first sub-evaporating unit assembly 150' connected to the outdoor unit 140 has a refrigerant outlet port 153*b*', while the sub-evaporating unit 150A connected to the expansion unit assembly 110' has a refrigerant inlet port 153*a*'. The sub-evaporating unit 160A of the second sub-evaporating unit assembly 160' connected to the indoor unit 120 has a refrigerant outlet port 163*b*', while the sub-evaporating unit 160B connected to the expansion unit assembly 110' has a refrigerant inlet port 163*a*'. Of course, it should be understood that the positions of the refrigerant inlet and outlet ports are not limited to the above-mentioned positions, but may be somewhat freely changed if the change does not affect the functioning of this invention.

The air conditioning system 100' according to the modification of the primary embodiment is improved in its heat exchanging capability, refrigerant expanding capability and refrigerant compressing capability since it has the multistage sub-evaporating unit assemblies, multi-stage expansion unit assembly, multi-stage sub-expansion unit assemblies and multi-stage compressor assembly, different from the air conditioning system 100 according to the primary embodiment. This modification is preferable since it is possible to improve the heating or cooling capability of the air conditioning system 100', in addition to reducing load applied to the elements of the air conditioning system 100'.

In the air conditioning system 100', it is preferable to mount a refrigerant dispenser 169 on the refrigerant pipe extending from the refrigerant outlet port of the first sub-expansion unit assembly 171' so as to feed the refrigerant from the sub-expansion unit assembly 171' to both sub-evaporating units 150A and 150B of the first sub-evaporating unit assembly 150', or feed either of the two sub-evaporating units 150A and 150B as desired. In the same manner, it is preferable to mount a refrigerant dispenser 169 on the refrigerant pipe extending from the refrigerant outlet port of the second sub-expansion unit assembly 172' so as to feed the refrigerant from the sub-expansion unit assembly 172' to both sub-evaporating units 160A and 160B of the second sub-evaporating unit assembly 160', or feed either of the two sub-evaporating units 160A and 160B as desired.

During an operation of the air conditioning system 100', it is possible to control both the temperature of refrigerant flowing from the first and second sub-evaporating unit assemblies 150' and 160' to the expansion unit assembly 110' and the temperature of refrigerant flowing in the first and second low temperature refrigerant outlet pipes 156 and 166 in accordance with the operational modes of the two refrigerant dispensers 169. This means that it is possible to control the operation of the air conditioning system 100' in a variety of operational modes.

Figure 4:
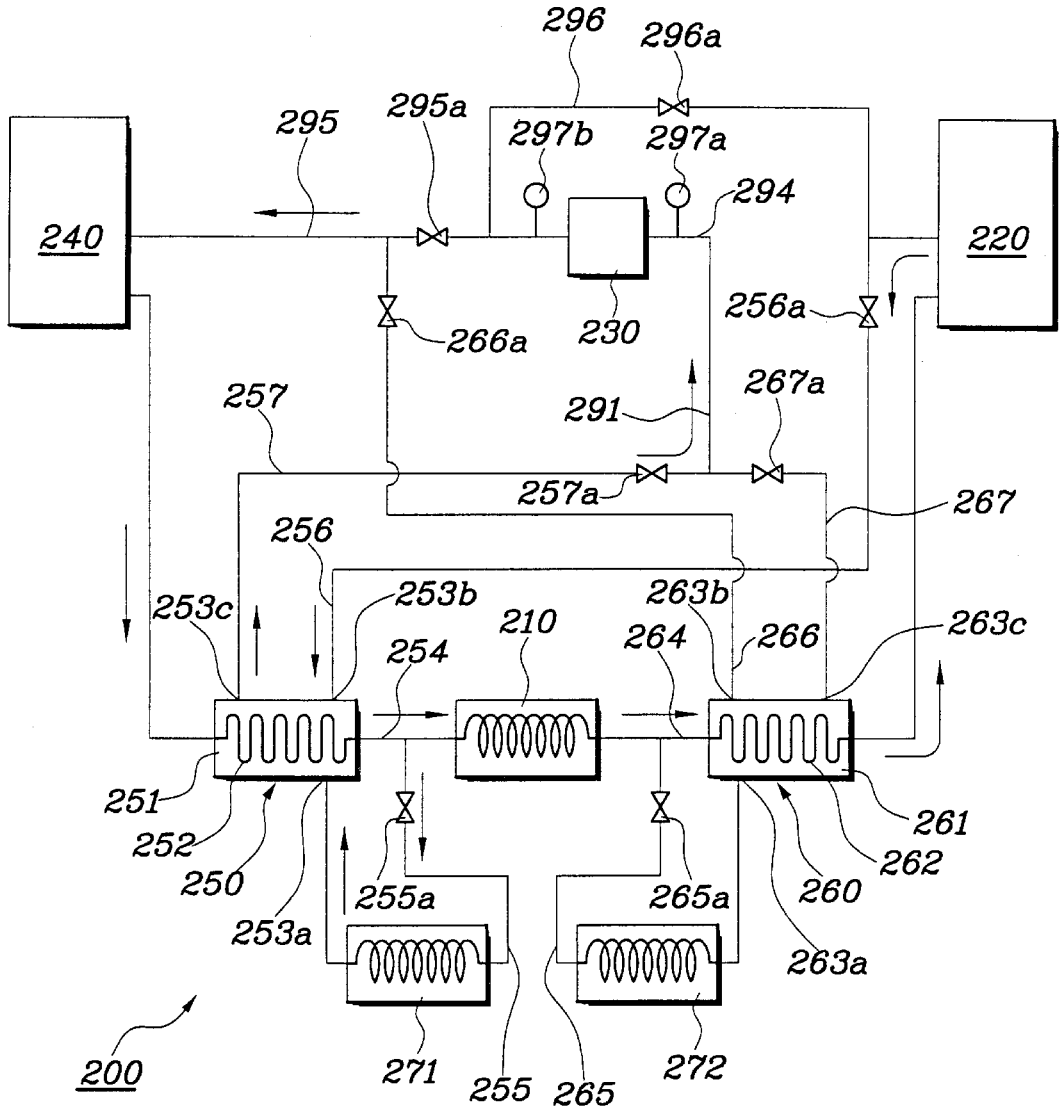
FIG. 4 is a block diagram, showing the refrigerant flow of a low compression load-type air conditioning system designed to perform a heating/cooling operation in accordance with the second embodiment of the present invention when the system is operated in a cooling mode.
Figure 5:
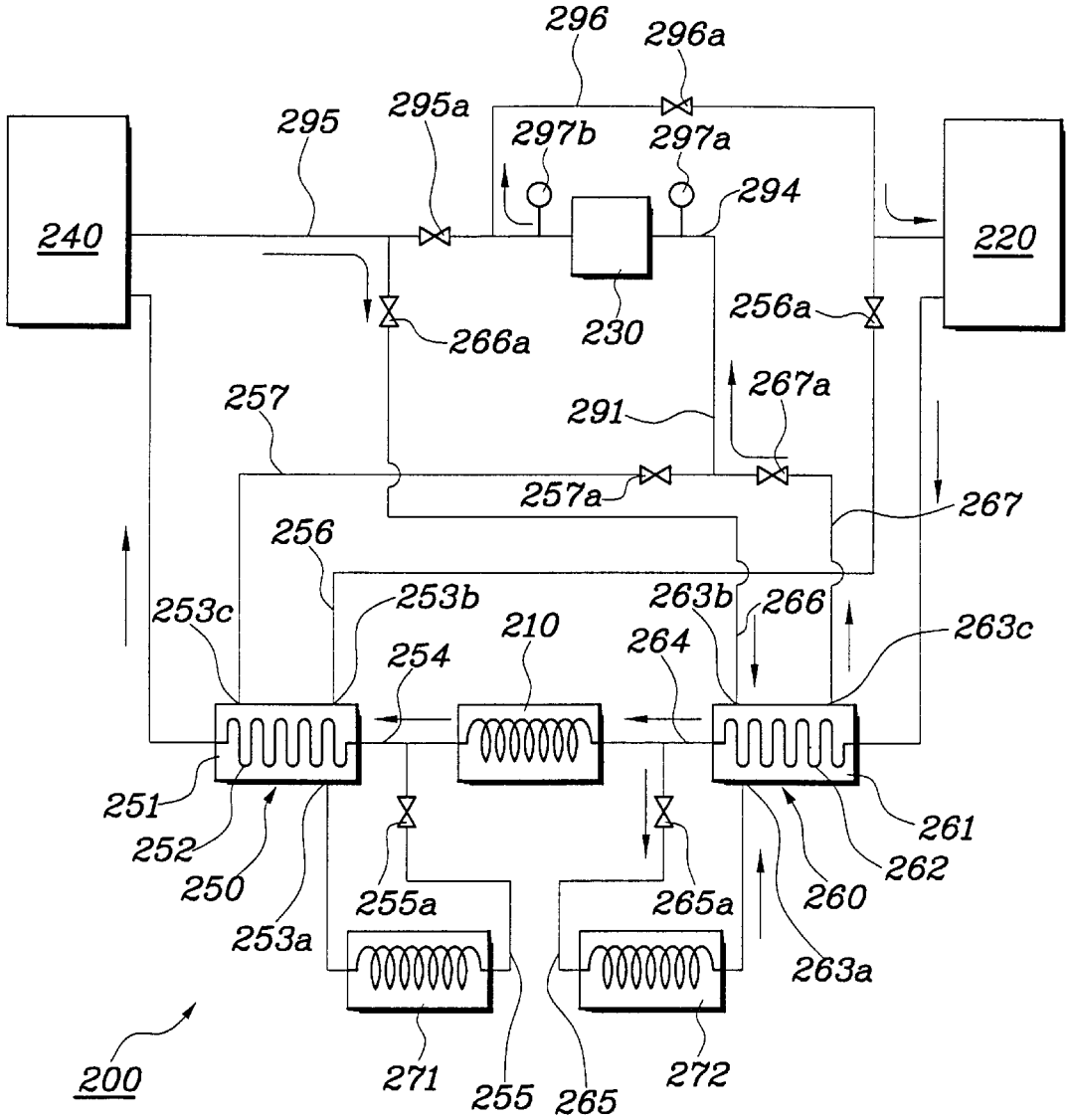
FIG. 5 is a block diagram, showing the refrigerant flow of the low compression load-type air conditioning system according to the second embodiment of this invention when the system is operated in a heating mode.

FIGS. 4 and 5 are block diagrams of an air conditioning system with low compression load in accordance with the second embodiment of the present invention. FIG. 4 shows the refrigerant flow of the system in a cooling mode. FIG. 5 shows the refrigerant flow of the system in a heating mode.

As shown in the drawings, the air conditioning system 200 according to the second embodiment comprises an expansion unit 210, an indoor unit 220, a compressor 230, and an outdoor unit 240. The expansion unit 210 adiabatically expands high pressure inlet refrigerant prior to discharging low pressure refrigerant. The indoor unit 220 has a heat exchanger, and is installed inside a target room. The compressor 230 adiabatically compresses low pressure inlet refrigerant prior to discharging high pressure refrigerant. The outdoor unit 240 has a heat exchanger, and is installed outside the target room. The expansion unit 210, indoor unit 220, compressor 230 and outdoor unit 240 are connected together by a pipeline to form a refrigerant passage of the system.

A first sub-evaporating unit 250 is mounted to the refrigerant pipeline between the expansion unit 210 and the outdoor unit 240, while a second sub-evaporating unit 260 is mounted to the refrigerant pipeline between the expansion unit 210 and the indoor unit 220. Each of the first and second sub-evaporating units 250 and 260 has a housing 251 or 261 receiving a heat exchanger 252 or 262 therein. The first heat exchanger 252 forms a refrigerant passage connecting the expansion unit 210 to the outdoor unit 240. The second heat exchanger 262 forms a refrigerant passage connecting the expansion unit 210 to the indoor unit 220. The two housings 251 and 261 each have a plurality of refrigerant inlet ports 253*a* and 253*b*, 263*a* and 263*b* and a refrigerant outlet port 253*c* or 263*c*. The refrigerant flowing into each of the housings 251 and 261 through associated refrigerant inlet ports 253*a* and 253*b*, 263*a* and 263*b* comes into contact with the external surface of an associated heat exchanger 252 or 262 while moving through a predetermined passage within the housing 251 or 261 prior to being discharged through an associated refrigerant outlet port 253*c* or 263*c*.

A first bypass pipe 255 branches from the first connection pipe 254 extending from the expansion unit 210 to the first sub-evaporating unit 250. A second bypass pipe 265 branches from the second connection pipe 264 extending from the expansion unit 210 to the second sub-evaporating unit 260. The first and second bypass pipes 255 and 265 each have a flow control valve 255*a* or 265*a*, and respectively extend to one ends of first and second sub-expansion units 271 and 272. The other ends of the first and second sub-expansion units 271 and 272 are respectively connected to the refrigerant inlet ports 253*a* and 263*a* of the first and second sub-evaporating units 250 and 260.

The other refrigerant inlet ports 253*b* and 263*b* of the first and second sub-evaporating units 250 and 260 are connected to one ends of first and second high temperature refrigerant inlet pipes 256 and 266. The other end of the first high temperature refrigerant inlet pipe 256 is connected to the indoor unit 220, while the other end of the second high temperature refrigerant inlet pipe 266 is connected to a second compressor pipe 295 extending between the outdoor unit 240 and the compressor 230.

The refrigerant outlet ports 253*c* and 263*c* of the first and second sub-evaporating units 250 and 260 are connected to one ends of first and second low temperature refrigerant outlet pipes 257 and 267. The other ends of the first and second low temperature refrigerant outlet pipes 257 and 267 are connected to each other at one end of a low temperature refrigerant supply pipe 291. The other end of the low temperature refrigerant supply pipe 291 is connected to the refrigerant inlet port of the compressor 230 through a first compressor pipe 294.

Each of the first and second high temperature refrigerant inlet pipes 256 and 266 and the first and second low temperature refrigerant outlet pipes 257 and 267 is provided with a flow control valve 256*a*, 266*a*, 257*a* or 267*a*.

A second compressor pipe 295 extends between the outdoor unit 240 and the compressor 230. A flow control valve 295*a* is mounted to the second compressor pipe 295 at a position between the compressor 230 and a joint of the second compressor pipe 295 and the second high temperature refrigerant inlet pipe 266. A pipe 296 branches from the second compressor pipe 295 at a position between the flow control valve 295*a* and the compressor 230, and is provide with a flow control valve 296*a*. The pipe 296 is connected to the first high temperature refrigerant inlet pipe 256 at a position between the flow control valve 256*a* and the indoor unit 220.

The first and second compressor pipes 294 and 295, connected to the refrigerant inlet and outlet ports of the compressor 230, are each preferably provided with a pressure gauge 297*a* or 297*b* for sensing pressure of inlet or outlet refrigerant of the compressor 230.

Figure 6:
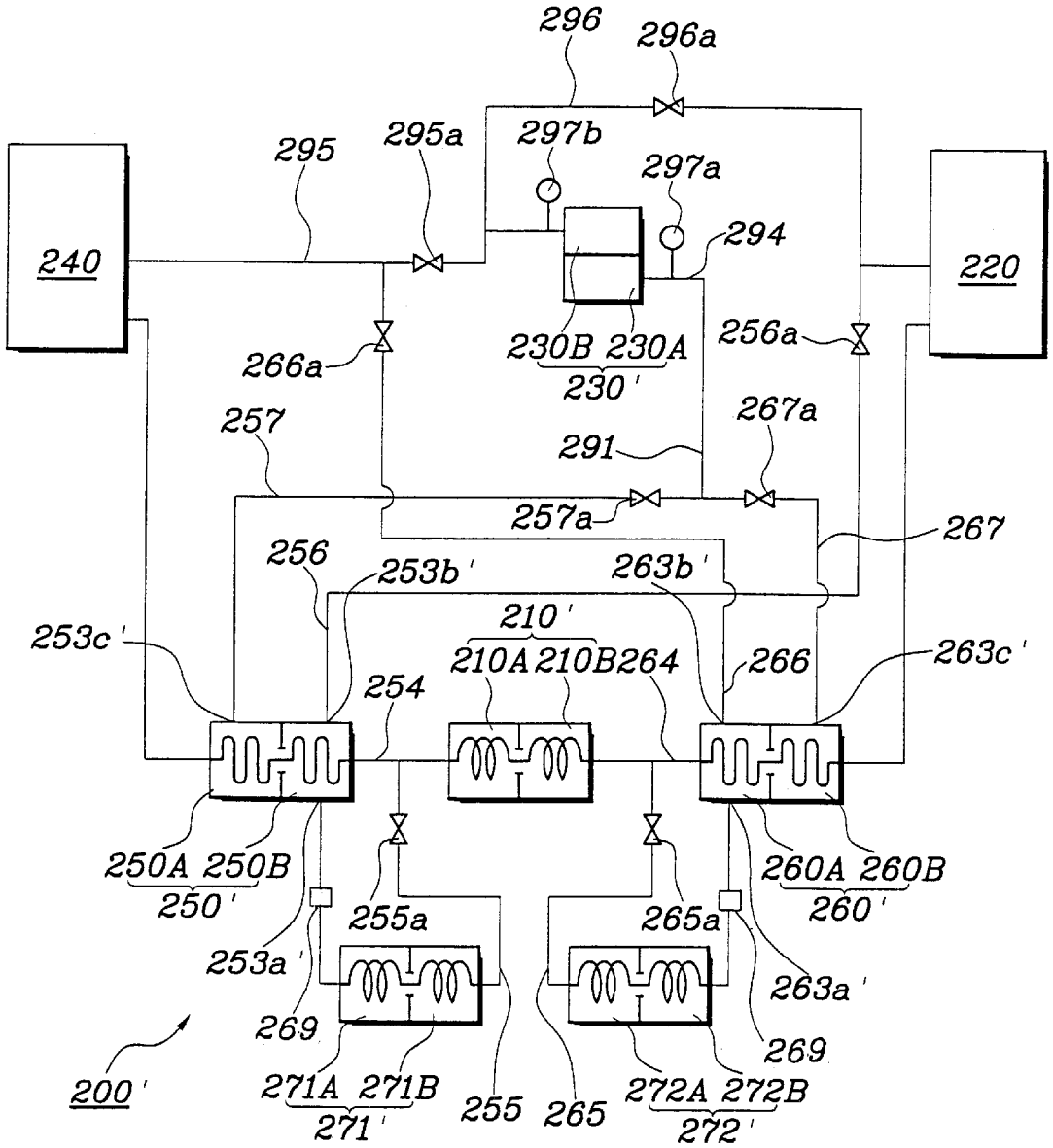
FIG. 6 is a block diagram of a low compression load-type air conditioning system in accordance with a modification of the second embodiment of this invention.

FIG. 6 is a block diagram of an air conditioning system in accordance with a modification of the second embodiment of this invention.

As shown in the drawing, the construction and refrigerant flowing passage of the air conditioning system 200' according to the modification is similar to those of the air conditioning system 200 according to the second embodiment. Therefore, the following description of the air conditioning system 200' is only to describe the construction and refrigerant flowing passage different from those of the air conditioning system 200.

The air conditioning system 200' according to the modification has an expansion unit assembly 210', which comprises two or more expansion units 210A and 210B arranged on the refrigerant pipeline of the air conditioning system 200' in a parallel arrangement or a series arrangement. In addition, the system 200' has a compressor assembly 230', which comprises two or more compressors 230A and 230B arranged on the refrigerant pipeline of the system 200' in a parallel arrangement or a series arrangement. The system 200' also has first and second sub-evaporating unit assemblies 250' and 260', each of which comprises two or more sub-evaporating units 250A and 250B, 260A and 260B arranged on the refrigerant pipeline of the system 200' in a parallel arrangement or a series arrangement. In addition, the system 200' has first and second sub-expansion unit assemblies 271' and 272', each of which comprises two or more sub-expansion units 271A and 271B, 272A and 272B arranged on the refrigerant pipeline of the system 200' in a parallel arrangement or a series arrangement.

The sub-evaporating unit 250B of the first sub-evaporating unit assembly 250' connected to the outdoor unit 240 has a refrigerant outlet port 253*c*', while the sub-evaporating unit 250A connected to the expansion unit assembly 210' has two refrigerant inlet ports 253*a*' and 253*b*'. The sub-evaporating unit 260A of the second sub-evaporating unit assembly 260' connected to the indoor unit 220 has a refrigerant outlet port 263*c*', while the sub-evaporating unit 260B connected to the expansion unit assembly 210' has two refrigerant inlet port 263*a*' and 263*b*'. Of course, it should be understood that the positions of the refrigerant inlet and outlet ports are not limited to the above-mentioned positions, but may be somewhat freely changed if the change does not affect the functioning of this invention.

The air conditioning system 200' according to the modification of the second embodiment is improved in its heat exchanging capability, refrigerant expanding capability and refrigerant compressing capability since it has the multistage sub-evaporating unit assemblies, multi-stage expansion unit assembly, multi-stage sub-expansion unit assemblies and multi-stage compressor assembly, different from the air conditioning system 200 according to the second embodiment. This modification is preferable since it is possible to improve the heating or cooling capability of the air conditioning system 200', in addition to reducing load applied to the elements of the air conditioning system 200'.

In the air conditioning system 200', it is preferable to mount a refrigerant dispenser 269 on the refrigerant pipe extending from the refrigerant outlet port of the first sub-expansion unit assembly 271' so as to feed the refrigerant from the sub-expansion unit assembly 271' to both sub-evaporating units 250A and 250B of the first sub-evaporating unit assembly 250', or feed either of the two sub-evaporating units 250A and 250B as desired. In the same manner, it is preferable to mount a refrigerant dispenser 269 on the refrigerant pipe extending from the refrigerant outlet port of the second sub-expansion unit assembly 272' so as to feed the refrigerant from the sub-expansion unit assembly 272' to both sub-evaporating units 260A and 260B of the second sub-evaporating unit assembly 260', or feed either of the two sub-evaporating units 260A and 260B as desired.

During an operation of the air conditioning system 200', it is possible to control both the temperature of refrigerant flowing from the first and second sub-evaporating unit assemblies 250' and 260' to the expansion unit assembly 210' and the temperature of refrigerant flowing in the first and second low temperature refrigerant outlet pipes 257 and 267 in accordance with the operational modes of the two refrigerant dispensers 269. This means that it is possible to control the operation of the air conditioning system 200' in a variety of operational modes.

Figure 7:
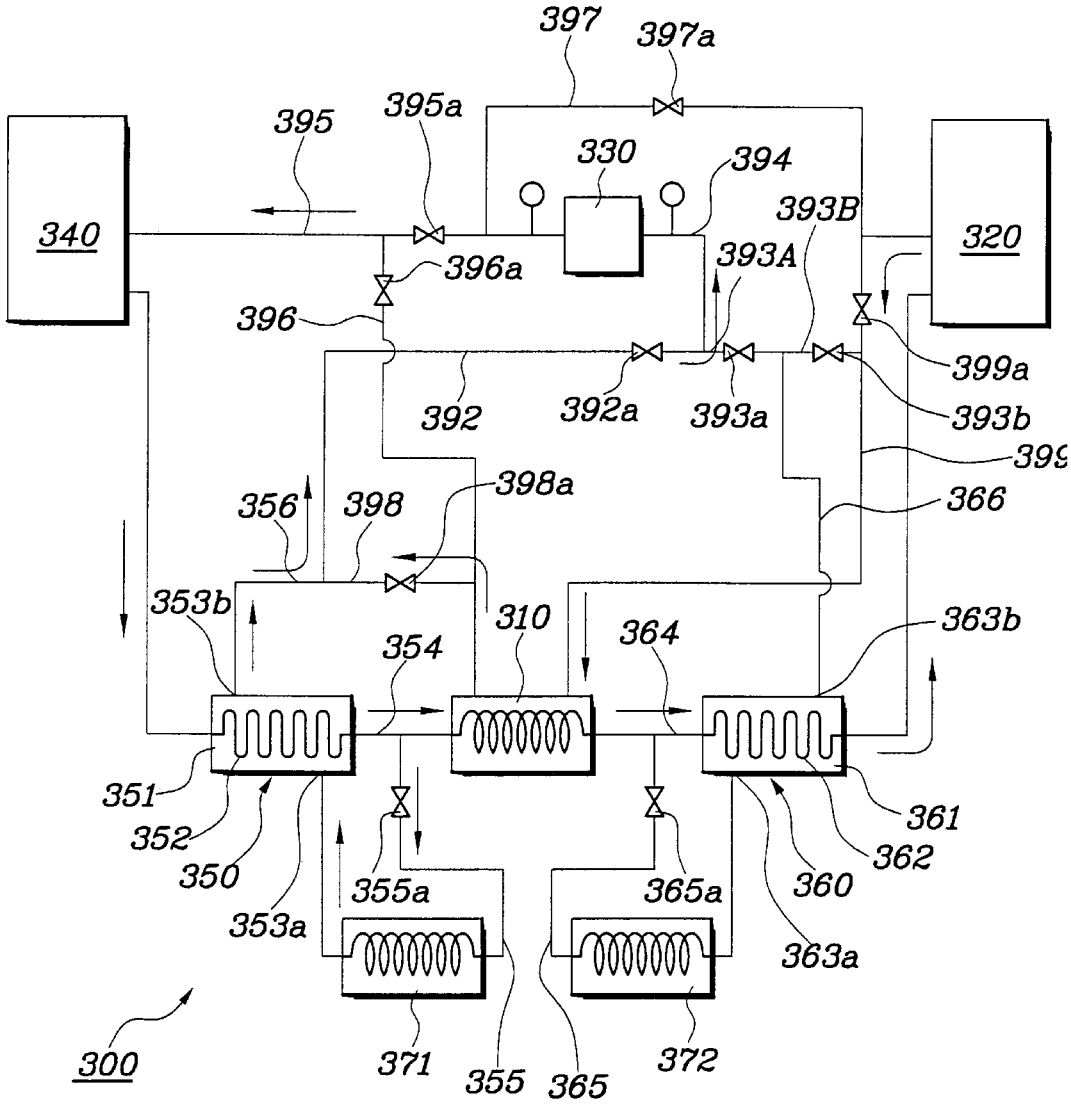
FIG. 7 is a block diagram, showing the refrigerant flow of a low compression load-type air conditioning system designed to perform a heating/cooling operation in accordance with the third embodiment of the present invention when the system is operated in a cooling mode.
Figure 8:
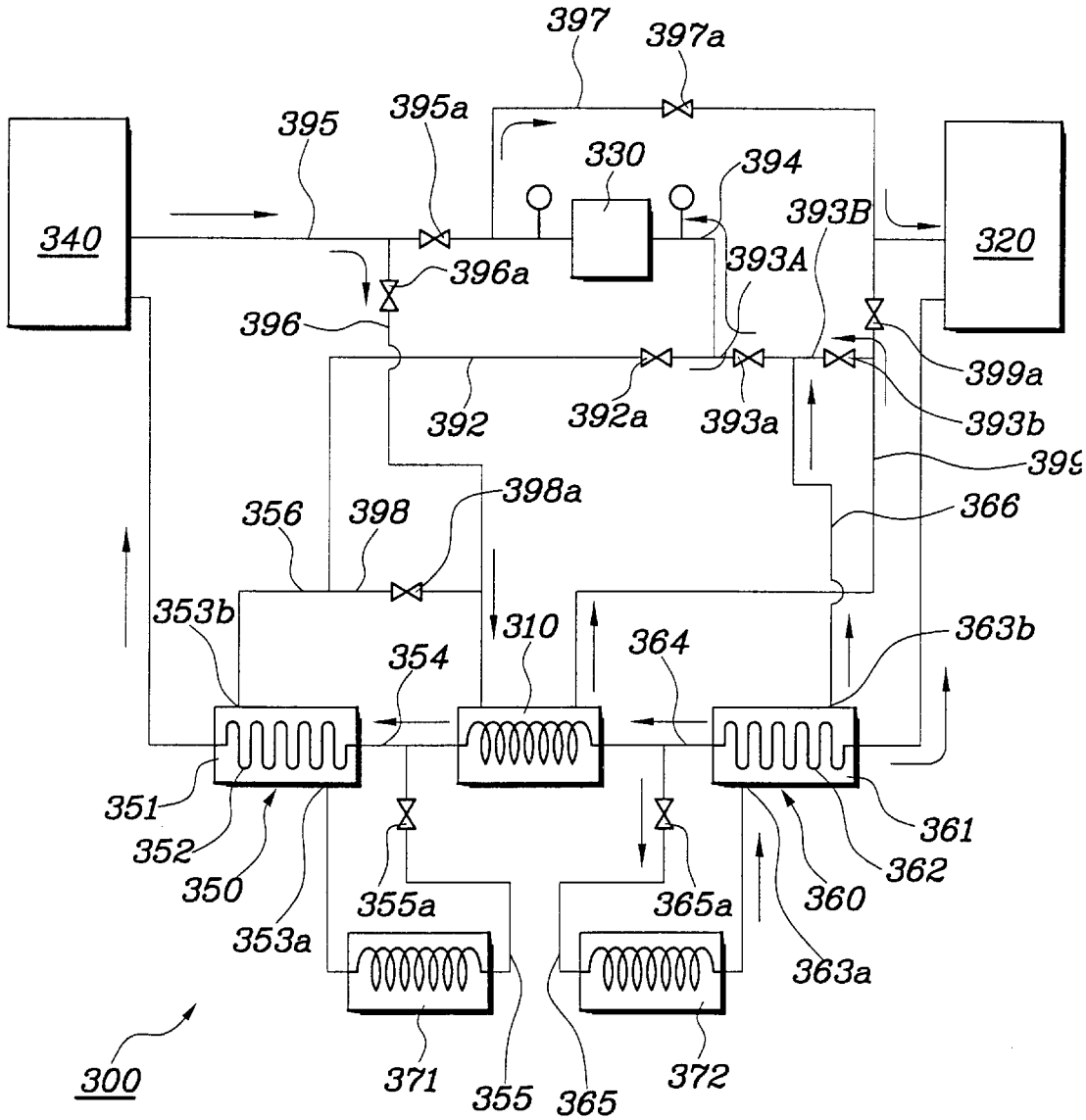
FIG. 8 is a block diagram, showing the refrigerant flow of the low compression load-type air conditioning system according to the third embodiment of this invention when the system is operated in a heating mode.

FIGS. 7 and 8 are block diagrams of an air conditioning system with low compression load in accordance with the third embodiment of the present invention. FIG. 7 shows the refrigerant flow of the system in a cooling mode. FIG. 8 shows the refrigerant flow of the system in a heating mode.

As shown in the drawings, the air conditioning system 300 according to the third embodiment comprises an expansion unit 310, an indoor unit 320, a compressor 330, and an outdoor unit 340. The expansion unit 310 adiabatically expands high pressure inlet refrigerant prior to discharging low pressure refrigerant. The indoor unit 320 has a heat exchanger, and is installed inside a target room. The compressor 330 adiabatically compresses low pressure inlet refrigerant prior to discharging high pressure refrigerant. The outdoor unit 340 has a heat exchanger, and is installed outside the target room. The expansion unit 310, indoor unit 320, compressor 330 and outdoor unit 340 are connected together by a pipeline to form a refrigerant passage of the system.

A first sub-evaporating unit 350 is mounted to the refrigerant pipeline between the expansion unit 310 and the outdoor unit 340, while a second sub-evaporating unit 360 is mounted to the refrigerant pipeline between the expansion unit 310 and the indoor unit 320. Each of the first and second sub-evaporating units 350 and 360 has a housing 351 or 361 receiving a heat exchanger 352 or 362 therein. The first heat exchanger 352 forms a refrigerant passage connecting the expansion unit 310 to the outdoor unit 340. The second heat exchanger 362 forms a refrigerant passage connecting the expansion unit 310 to the indoor unit 320. The two housings 351 and 361 each have a refrigerant inlet port 353*a* or 363*a* and a refrigerant outlet port 353*b* or 363*b*. The refrigerant flowing into each of the housings 351 and 361 through an associated refrigerant inlet port 353*a* or 363*a* comes into contact with the external surface of an associated heat exchanger 352 or 362 while moving through a predetermined passage within the housing 351 or 361 prior to being discharged through an associated refrigerant outlet port 353*b* or 363*b*.

A first bypass pipe 355 branches from the first connection pipe 354 extending from the expansion unit 310 to the first sub-evaporating unit 350. A second bypass pipe 365 branches from the second connection pipe 364 extending from the expansion unit 310 to the second sub-evaporating unit 360. The first and second bypass pipes 355 and 365 each have a flow control valve 355*a* or 365*a*, and respectively extend to one ends of first and second sub-expansion units 371 and 372. The other ends of the first and second sub-expansion units 371 and 372 are respectively connected to the refrigerant inlet ports 353*a* and 363*a* of the first and second sub-evaporating units 350 and 360.

The refrigerant outlet ports 353*b* and 363*b* of the first and second sub-evaporating units 350 and 360 are connected to one ends of first and second low temperature refrigerant outlet pipes 356 and 366. The other ends of the first and second low temperature refrigerant outlet pipes 356 and 366 are connected to each other at one end of a low temperature refrigerant supply pipe 391 through first and second refrigerant pipes 392 and 393A. The other end of the low temperature refrigerant supply pipe 391 is connected to the refrigerant inlet port of the compressor 330 through a first compressor pipe 394. The first and second refrigerant pipes 392 and 393A each have a flow control valve 392*a* and 393*a*.

A second compressor pipe 395 extends between the outdoor unit 340 and the compressor 330. A flow control valve 395*a* is mounted to the second compressor pipe 395. Third and fourth refrigerant pipes 396 and 397 branch from the second compressor pipe 395 at opposite positions of the flow control valve 395*a*. The third refrigerant pipe 396, jointed to the compressor pipe 395 at a position close to the outdoor unit 340, has a flow control valve 396*a*, and is connected to the first refrigerant port 311 of the expansion unit 310. The fourth refrigerant pipe 397, jointed to the compressor pipe 395 at a position close to the compressor 330, has a flow control valve 397*a*, and is connected to the indoor unit 320.

A fifth refrigerant pipe 398 branches from the third refrigerant pipe 396 at a position between the flow control valve 396*a* and the expansion unit 310. This fifth refrigerant pipe 398 has a flow control valve 398*a*, and is connected to the joint of the first low temperature refrigerant outlet pipe 356 and the first refrigerant pipe 392. A sixth refrigerant pipe 399 branches from the second refrigerant pipe 397 at a position between the flow control valve 397*a* and the indoor unit 320. This sixth refrigerant pipe 399 has a flow control valve 399*a*, and is connected to the second refrigerant port 312 of the expansion unit 310. A seventh refrigerant pipe 393B branches from the sixth refrigerant pipe 399 at a position between the flow control valve 399*a* and the expansion unit 310. This seventh refrigerant pipe 393B has a flow control valve 393*b*, and is connected to the joint of the second refrigerant outlet pipe 366 and the second refrigerant pipe 393A.

The first and second compressor pipes 394 and 395, connected to the refrigerant inlet and outlet ports of the compressor 330, are each preferably provided with a pressure gauge for sensing pressure of inlet or outlet refrigerant of the compressor 330.

Figure 9:
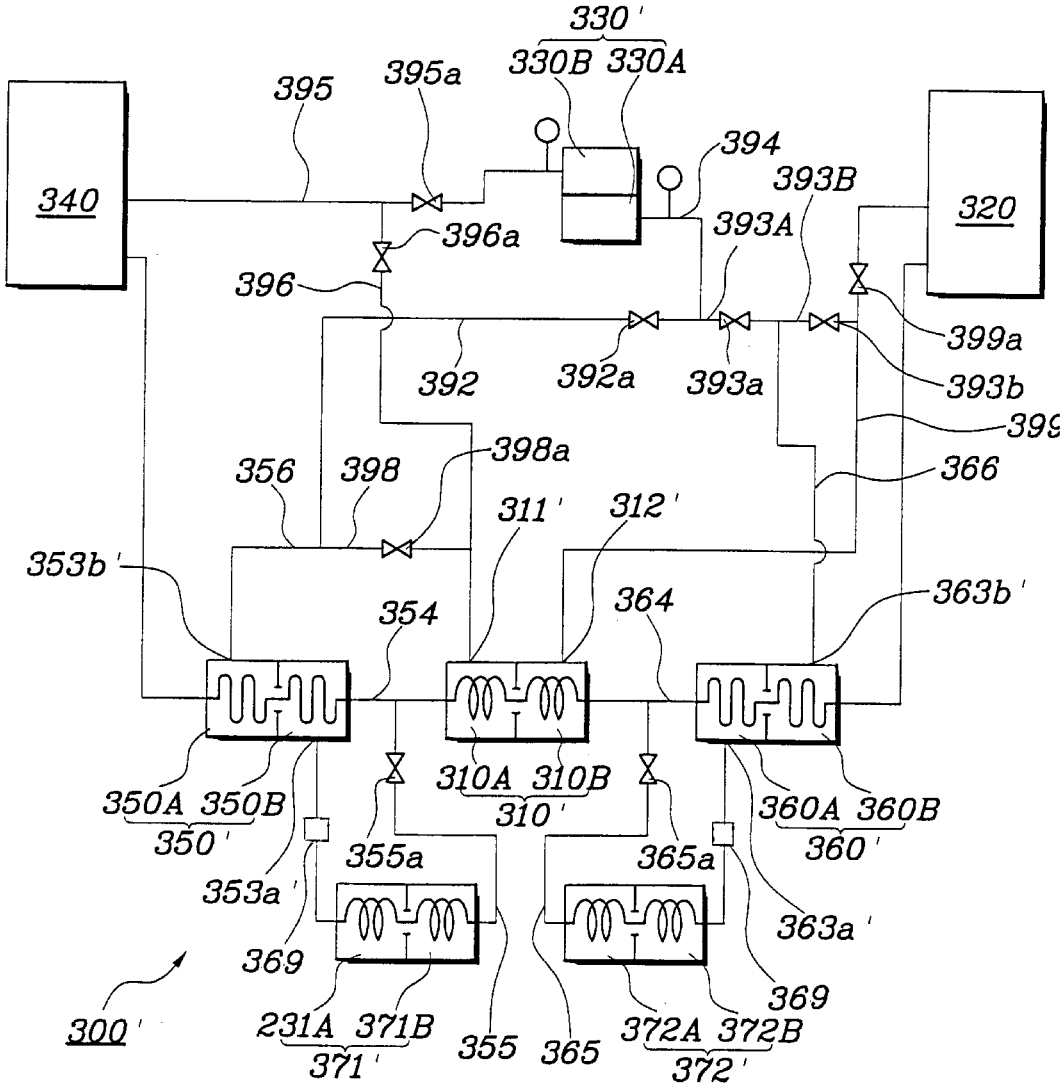
FIG. 9 is a block diagram of a low compression load-type air conditioning system in accordance with a modification of the third embodiment of this invention.

FIG. 9 is a block diagram of an air conditioning system in accordance with a modification of the third embodiment of this invention.

As shown in the drawing, the construction and refrigerant flowing passage of the air conditioning system 300' according to the modification are similar to those of the air conditioning system 300 according to the third embodiment. Therefore, the following description of the air conditioning system 300' is only to describe the construction and refrigerant flowing passage different from those of the air conditioning system 300.

The air conditioning system 300' according to the modification has an expansion unit assembly 310', which comprises two or more expansion units 310A and 310B arranged on the refrigerant pipeline of the air conditioning system 300' in a parallel arrangement or a series arrangement. In addition, the system 300' has a compressor assembly 330', which comprises two or more compressors 330A and 330B arranged on the refrigerant pipeline of the system 300' in a parallel arrangement or a series arrangement. The system 300' also has first and second sub-evaporating unit assemblies 350' and 360', each of which comprises two or more sub-evaporating units 350A and 350B, 360A and 360B arranged on the refrigerant pipeline of the system 300' in a parallel arrangement or a series arrangement. In addition, the system 300' has first and second sub-expansion unit assemblies 371' and 372', each of which comprises two or more sub-expansion units 371A and 371B, 372A and 372B arranged on the refrigerant pipeline of the system 300' in a parallel arrangement or a series arrangement.

The sub-evaporating unit 350B of the first sub-evaporating unit assembly 350' connected to the outdoor unit 340 has a refrigerant outlet port 353*b*', while the sub-evaporating unit 350A connected to the expansion unit assembly 310' has a refrigerant inlet port 353*a*'. The sub-evaporating unit 360A of the second sub-evaporating unit assembly 360' connected to the indoor unit 320 has a refrigerant outlet port 363*b*', while the sub-evaporating unit 360B connected to the expansion unit assembly 310' has a refrigerant inlet port 363*a*'. The expansion unit 310A of the expansion unit assembly 310' connected to the first sub-evaporating unit assembly 350' has a first refrigerant port 311', while the expansion unit 310B connected to the second sub-evaporating unit assembly 360' has a second refrigerant port 312'. Of course, it should be understood that the positions of the refrigerant inlet and outlet ports are not limited to the above-mentioned positions, but may be somewhat freely changed if the change does not affect the functioning of this invention.

The air conditioning system 300' according to the modification of the third embodiment is improved in its heat exchanging capability, refrigerant expanding capability and refrigerant compressing capability since it has the multistage sub-evaporating unit assemblies, multi-stage expansion unit assembly, multi-stage sub-expansion unit assemblies and multi-stage compressor assembly, different from the air conditioning system 300 according to the third embodiment. This modification is preferable since it is possible to improve the heating or cooling capability of the air conditioning system 300', in addition to reducing load applied to the elements of the air conditioning system 300'.

In the air conditioning system 300', it is preferable to mount a refrigerant dispenser 369 on the refrigerant pipe extending from the refrigerant outlet port of the first sub-expansion unit assembly 371' so as to feed the refrigerant from the sub-expansion unit assembly 371' to both sub-evaporating units 350A and 350B of the first sub-evaporating unit assembly 350', or feed either of the two sub-evaporating units 350A and 350B as desired. In the same manner, it is preferable to mount a refrigerant dispenser 369 on the refrigerant pipe extending from the refrigerant outlet port of the second sub-expansion unit assembly 372' so as to feed the refrigerant from the sub-expansion unit assembly 372' to both sub-evaporating units 360A and 360B of the second sub-evaporating unit assembly 360', or feed either of the two sub-evaporating units 360A and 360B as desired.

During an operation of the air conditioning system 300', it is possible to control both the temperature of refrigerant flowing from the first and second sub-evaporating unit assemblies 350' and 360' to the expansion unit assembly 310' and the temperature of refrigerant flowing in the first and second low temperature refrigerant outlet pipes 356 and 366 in accordance with the operational modes of the two refrigerant dispensers 369. This means that it is possible to control the operation of the air conditioning system 300' in a variety of operational modes.

Figure 10:
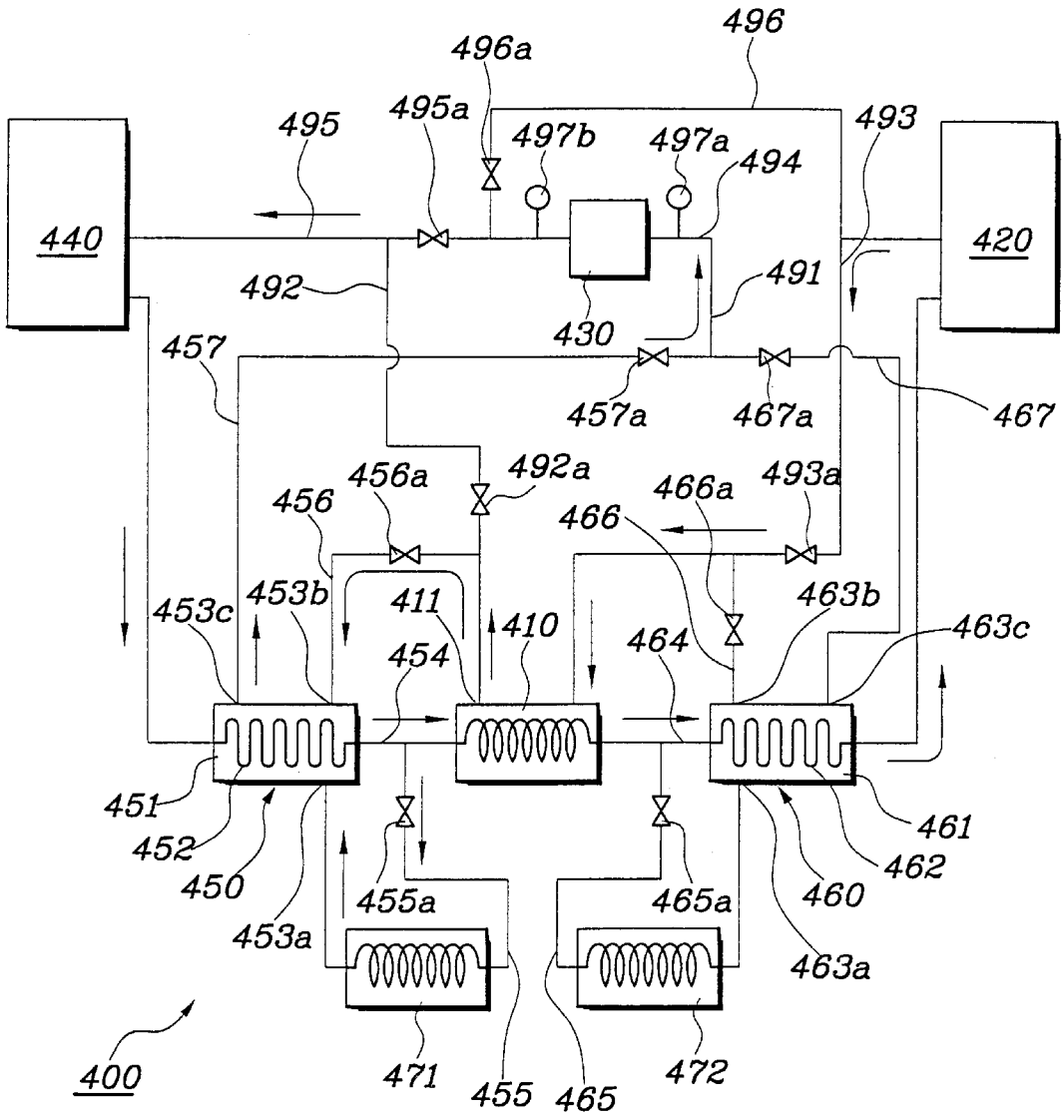
FIG. 10 is a block diagram, showing the refrigerant flow of a low compression load-type air conditioning system designed to perform a heating/cooling operation in accordance with the fourth embodiment of the present invention when the system is operated in a cooling mode.
Figure 11:
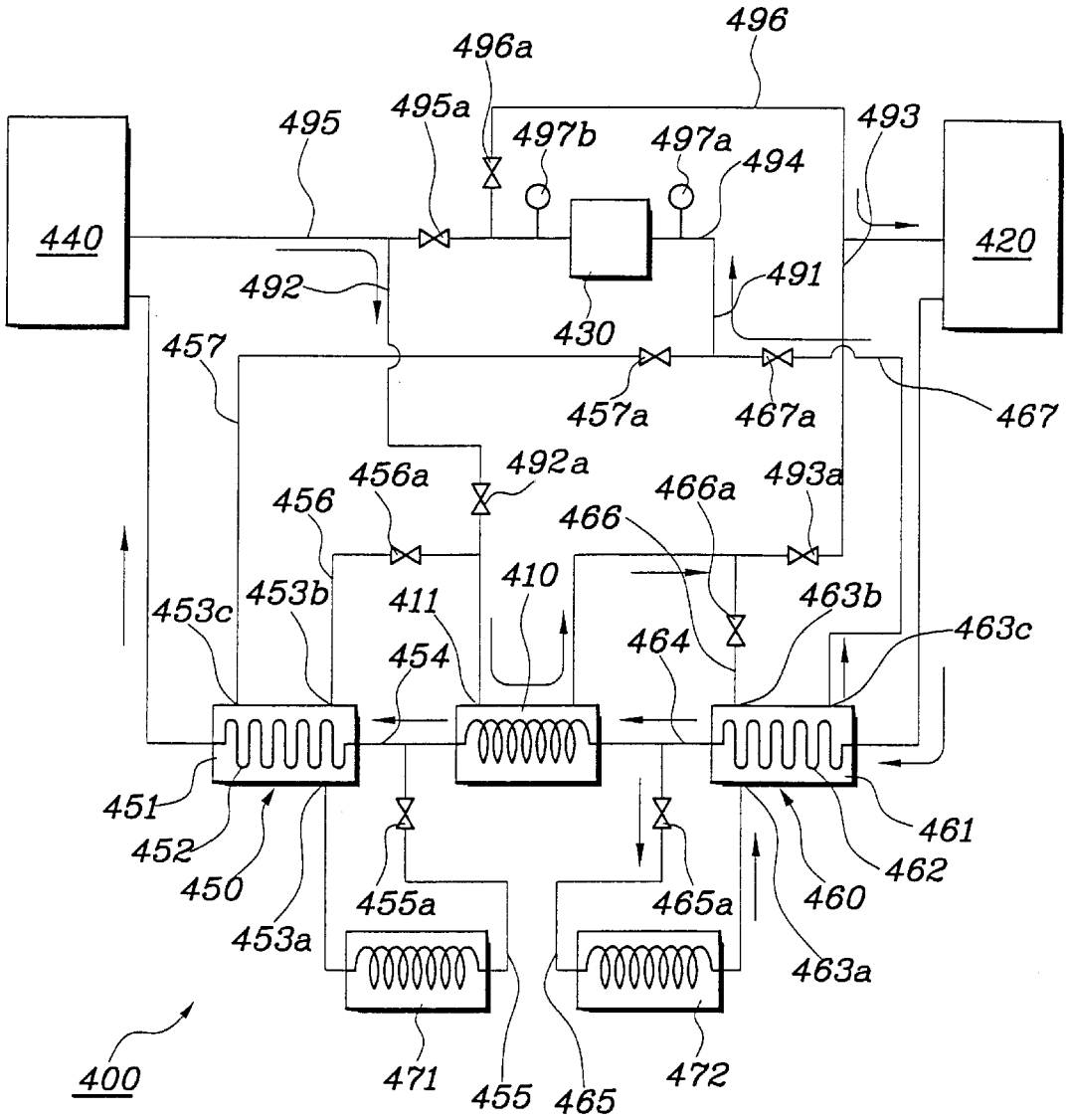
FIG. 11 is a block diagram, showing the refrigerant flow of the low compression load-type air conditioning system according to the fourth embodiment of this invention when the system is operated in a heating mode.

FIGS. 10 and 11 are block diagrams of an air conditioning system with low compression load in accordance with the fourth embodiment of the present invention. FIG. 10 shows the refrigerant flow of the system in a cooling mode. FIG. 11 shows the refrigerant flow of the system in a heating mode.

As shown in the drawings, the air conditioning system 400 according to the fourth embodiment comprises an expansion unit 410, an indoor unit 420, a compressor 430, and an outdoor unit 440. The expansion unit 410 adiabatically expands high pressure inlet refrigerant prior to discharging low pressure refrigerant. The indoor unit 420 has a heat exchanger, and is installed inside a target room. The compressor 430 adiabatically compresses low pressure inlet refrigerant prior to discharging high pressure refrigerant. The outdoor unit 440 has a heat exchanger, and is installed outside the target room. The expansion unit 410, indoor unit 420, compressor 430 and outdoor unit 440 are connected together by a pipeline to form a refrigerant passage of the system.

A first sub-evaporating unit 450 is mounted to the refrigerant pipeline between the expansion unit 410 and the outdoor unit 440, while a second sub-evaporating unit 460 is mounted to the refrigerant pipeline between the expansion unit 410 and the indoor unit 420. Each of the first and second sub-evaporating units 450 and 460 has a housing 451 or 461 receiving a heat exchanger 452 or 462 therein. The first heat exchanger 452 forms a refrigerant passage connecting the expansion unit 410 to the outdoor unit 440. The second heat exchanger 462 forms a refrigerant passage connecting the expansion unit 410 to the indoor unit 420. The two housings 451 and 461 each have a plurality of refrigerant inlet ports 453*a* and 453*b*, 463*a* and 463*b* and a refrigerant outlet port 453*c* or 463*c*. The refrigerant flowing into each of the housings 451 and 461 through associated refrigerant inlet ports 453*a* and 453*b*, 463*a* and 463*b* comes into contact with the external surface of an associated heat exchanger 452 or 462 while moving through a predetermined passage within the housing 451 or 461 prior to being discharged through an associated refrigerant outlet port 453*c* or 463*c*.

A first bypass pipe 455 branches from the first connection pipe 454 extending from the expansion unit 410 to the first sub-evaporating unit 450. A second bypass pipe 465 branches from the second connection pipe 464 extending from the expansion unit 410 to the second sub-evaporating unit 460. The first and second bypass pipes 455 and 465 each have a flow control valve 455*a* or 465*a*, and respectively extend to one ends of first and second sub-expansion units 471 and 472. The other ends of the first and second sub-expansion units 471 and 472 are respectively connected to the refrigerant inlet ports 453*a* and 463*a* of the first and second sub-evaporating units 450 and 460.

The other refrigerant inlet ports 453*b* and 463*b* of the first and second sub-evaporating units 450 and 460 are connected to one ends of first and second high temperature refrigerant inlet pipes 456 and 466. The refrigerant outlet ports 453*c* and 463*c* of the first and second sub-evaporating units 450 and 460 are connected to each other at one end of a low temperature refrigerant supply pipe 491 through first and second low temperature refrigerant outlet pipes 457 and 467. The other end of the low temperature refrigerant supply pipe 491 is connected to the refrigerant inlet port of the compressor 430 through a first compressor pipe 494.

Each of the first and second high temperature refrigerant inlet pipes 456 and 466 and the first and second low temperature refrigerant outlet pipes 457 and 467 is provided with a flow control valve 456*a*, 466*a*, 457*a* or 467*a*.

The other end of the first high temperature refrigerant inlet pipes 456 is connected to a predetermined position of the first refrigerant pipe 492, while one end of the first refrigerant pipe 492 is connected to the first refrigerant port 411 of the expansion unit 410. The other end of the first refrigerant pipe 492 is connected to a predetermined position of the second compressor pipe 495 extending from the refrigerant outlet port of the compressor 430. A flow control valve 492*a* is mounted to the first refrigerant pipe 492 at a position between the first high temperature refrigerant inlet pipe 456 and the second compressor pipe 495.

The second high temperature refrigerant inlet pipes 466 is connected to a predetermined position of the second refrigerant pipe 493, while one end of the second refrigerant pipe 493 is connected to the second refrigerant port 412 of the expansion unit 410. The other end of the second refrigerant pipe 493 is connected to the indoor unit 420. A flow control valve 493*a* is mounted to the second refrigerant pipe 493 at a position between the second high temperature refrigerant inlet pipe 466 and the indoor unit 420.

A flow control valve 495*a* is mounted to the second compressor pipe 495 at a position between the first refrigerant pipe 492 and the compressor 430. The second refrigerant pipe 493 and the second compressor pipe 495 are connected to each other through the third refrigerant pipe 496. One end of the third refrigerant pipe 496 is connected to the second refrigerant pipe 493 at a position between the flow control valve 493*a* and the indoor unit 420. The other end of the third refrigerant pipe 496 is connected to the second compressor pipe 495 at a position between the flow control valve 495*a* and the compressor 430. The third refrigerant pipe 496 has a flow control valve 496*a*.

The first and second compressor pipes 494 and 495, connected to the refrigerant inlet and outlet ports of the compressor 430, are each preferably provided with a pressure gauge 497*a* or 497*b* for sensing pressure of inlet or outlet refrigerant of the compressor 430.

Figure 12:
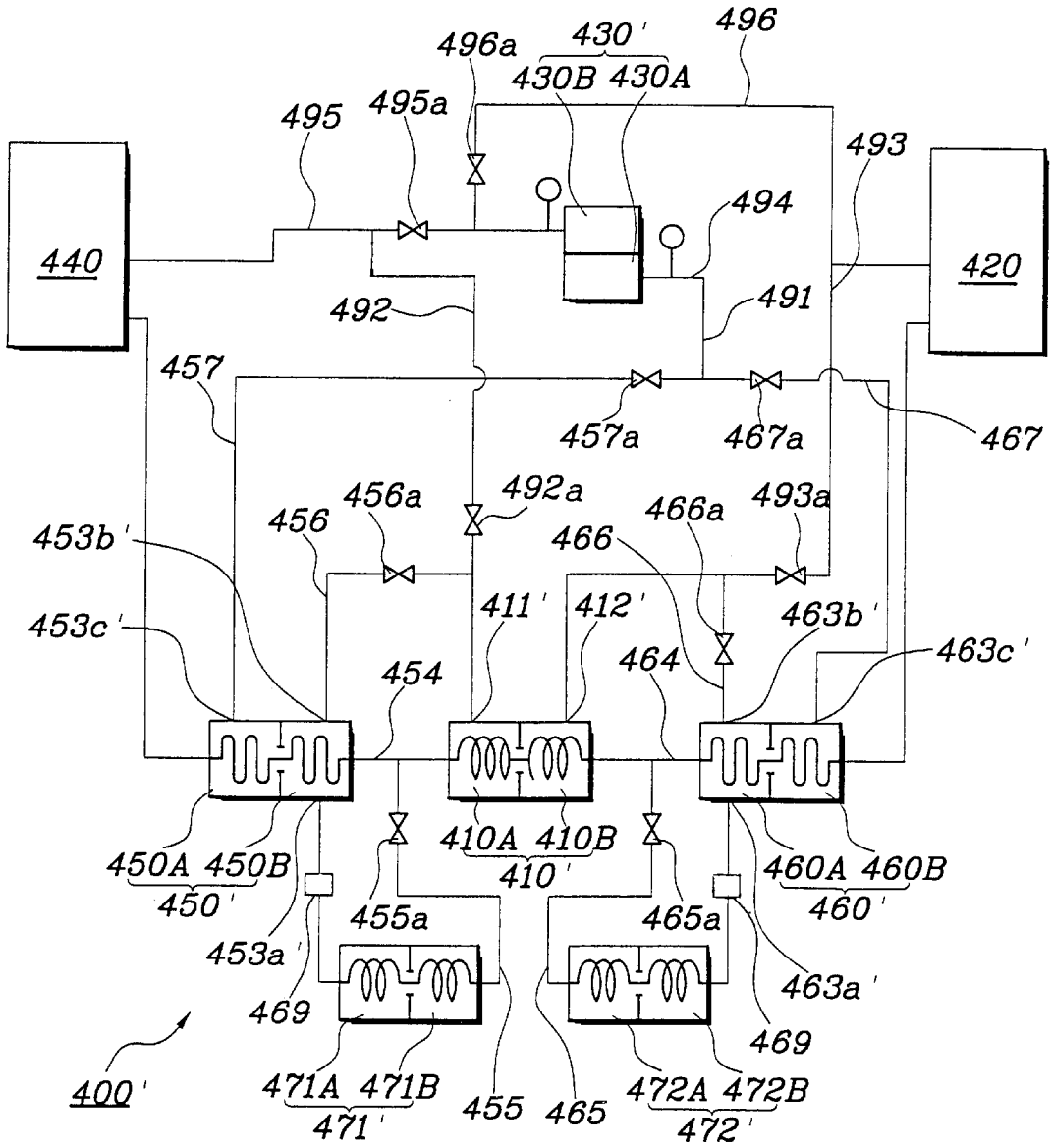
FIG. 12 is a block diagram of a low compression load-type air conditioning system in accordance with a modification of the fourth embodiment of this invention.

FIG. 12 is a block diagram of an air conditioning system in accordance with a modification of the fourth embodiment of this invention.

As shown in the drawing, the construction and refrigerant flowing passage of the air conditioning system 400' according to the modification is similar to those of the air conditioning system 400 according to the fourth embodiment. Therefore, the following description of the air conditioning system 400' is only to describe the construction and refrigerant flowing passage different from those of the air conditioning system 400.

The air conditioning system 400' according to the modification has an expansion unit assembly 410', which comprises two or more expansion units 410A and 410B arranged on the refrigerant pipeline of the air conditioning system 400' in a parallel arrangement or a series arrangement. In addition, the system 400' has a compressor assembly 430', which comprises two or more compressors 430A and 430B arranged on the refrigerant pipeline of the system 400' in a parallel arrangement or a series arrangement. The system 400' also has first and second sub-evaporating unit assemblies 450' and 460', each of which comprises two or more sub-evaporating units 450A and 450B, 460A and 460B arranged on the refrigerant pipeline of the system 400' in a parallel arrangement or a series arrangement. In addition, the system 400' has first and second sub-expansion unit assemblies 471' and 472', each of which comprises two or more sub-expansion units 471A and 471B, 472A and 472B arranged on the refrigerant pipeline of the system 400' in a parallel arrangement or a series arrangement.

The sub-evaporating unit 450B of the first sub-evaporating unit assembly 450' connected to the outdoor unit 440 has a refrigerant outlet port 453*c*', while the sub-evaporating unit 450A connected to the expansion unit assembly 410' has two refrigerant inlet ports 453*a*' and 453*b*'. The sub-evaporating unit 460A of the second sub-evaporating unit assembly 460' connected to the indoor unit 420 has a refrigerant outlet port 463*c*', while the sub-evaporating unit 460B connected to the expansion unit assembly 410' has two refrigerant inlet port 463*a*' and 463*b*'. The expansion unit 410A of the expansion unit assembly 410' connected to the first sub-evaporating unit assembly 450' has a first refrigerant port 411', while the expansion unit 410B connected to the second sub-evaporating unit assembly 460' has a second refrigerant port 412'. Of course, it should be understood that the positions of the refrigerant inlet and outlet ports are not limited to the above-mentioned positions, but may be somewhat freely changed if the change does not affect the functioning of this invention.

The air conditioning system 400' according to the modification of the fourth embodiment is improved in its heat exchanging capability, refrigerant expanding capability and refrigerant compressing capability since it has the multistage sub-evaporating unit assemblies, multi-stage expansion unit assembly, multi-stage sub-expansion unit assemblies and multi-stage compressor assembly, different from the air conditioning system 400 according to the fourth embodiment. This modification is preferable since it is possible to improve the heating or cooling capability of the air conditioning system 400', in addition to reducing load applied to the elements of the air conditioning system 400'.

In the air conditioning system 400', it is preferable to mount a refrigerant dispenser 469 on the refrigerant pipe extending from the refrigerant outlet port of the first sub-expansion unit assembly 471' so as to feed the refrigerant from the sub-expansion unit assembly 471' to both sub-evaporating units 450A and 450B of the first sub-evaporating unit assembly 450', or feed either of the two sub-evaporating units 450A and 450B as desired. In the same manner, it is preferable to mount a refrigerant dispenser 469 on the refrigerant pipe extending from the refrigerant outlet port of the second sub-expansion unit assembly 472' so as to feed the refrigerant from the sub-expansion unit assembly 472' to both sub-evaporating units 460A and 460B of the second sub-evaporating unit assembly 460', or feed either of the two sub-evaporating units 460A and 460B as desired.

During an operation of the air conditioning system 400', it is possible to control both the temperature of refrigerant flowing from the first and second sub-evaporating unit assemblies 450' and 460' to the expansion unit assembly 410' and the temperature of refrigerant flowing in the first and second low temperature refrigerant outlet pipes 457 and 467 in accordance with the operational modes of the two refrigerant dispensers 469. This means that it is possible to control the operation of the air conditioning system 400' in a variety of operational modes.

Of course, it should be understood that the air conditioning system with low compression load of this invention may be designed to exclusively perform a cooling operation, or a heating operation by removing some elements from the heating/cooling system of FIGS. 1 to 12.

In the primary to fourth embodiments of this invention, the air conditioning system has one indoor unit 120, 220, 320 or 420. However, the air conditioning system of this invention may have a plurality of indoor units, which are arranged on the refrigerant pipeline of the air conditioning system in a parallel arrangement or a series arrangement, without affecting the functioning of this invention. In such a case, it is possible to control the air conditioning system to feed the refrigerant to all the indoor units or feed the refrigerant selected indoor units as desired.

Each of the air conditioning systems according to the primary to fourth embodiments of this invention has the following operational effect.

The operational effect of the air conditioning system 100 according to the primary embodiment will be described herein below with reference to FIGS. 1 and 2.

In a cooling mode operation of the system 100 of FIG. 1, the flow control valve 194*a* of the first compressor pipe 194 and the flow control valves 195*a* and 195*b* of the second compressor pipe 195 are opened, while the flow control valve 196*a* of the pipe 196 is closed.

At the indoor unit 120, the refrigerant absorbs heat from air inside a target room to evaporate prior to flowing into the compressor 130 through the first compressor pipe 194. The refrigerant is compressed at the compressor 130, and is discharged to the outdoor unit 140 through the second compressor pipe 195. At the outdoor unit 140, the refrigerant dissipates heat to atmospheric air outside the room to be condensed. The refrigerant from the outdoor unit 140 passes through the expansion unit 110 while being expanded, and flows into the indoor unit 120, thus finishing one cycle of the cooling mode operation.

In the cooling operation of the system 100, the flow control valve 155*a* of the first bypass pipe 155 branching from the first connection pipe 154 at a position in front of the expansion unit 110 is opened, while the flow control valve 165*a* of the second bypass pipe 165 branching from the second connection pipe 164 at a position in back of the expansion unit 110 is closed.

The refrigerant flowing from the first sub-evaporating unit 150 to the expansion unit 110 partially flows into the first sub-expansion unit 171 through the first bypass pipe 155 to be expanded. Therefore, at the first sub-evaporating unit 150, heat is transferred between the bypassed refrigerant flowing into the first sub-evaporating unit 150 through the refrigerant inlet port 153*a* and the refrigerant flowing from the outdoor unit 140 to the main expansion unit 110 through the first sub-evaporating unit 150.

In the cooling operation of the system 100, both the flow control valve 156*a* of the first low temperature refrigerant outlet pipe 156 and the flow control valve 192*a* of the first refrigerant pipe 192 are opened, while both the flow control valve 166*a* of the second low temperature refrigerant outlet pipe 166 and the flow control valve 193*a* of the second refrigerant pipe 193 are closed.

Therefore, the refrigerant from the outlet port 153*b* of the first sub-evaporating unit 150 passes through the first low temperature refrigerant pipe 156, the low temperature refrigerant supply pipe 191 and the first refrigerant pipe 192 prior to flowing into the first compressor pipe 194. Within the first compressor pipe 194, the refrigerant from the first sub-evaporating unit 150 is mixed with the refrigerant from the indoor unit 120 prior to flowing into the compressor 130.

In such a case, since the flow control valve 165*a* of the second bypass pipe 165 is closed, the refrigerant flowing from the expansion unit 110 to the second sub-evaporating unit 160 simply flows to the indoor unit 120 without being additionally processed.

During such a cooling mode operation of the air conditioning system 100, the refrigerant flowing from the outdoor unit 140 is reduced in its temperature from 25° C. to 5° C. while passing through the first sub-evaporating unit 150, and flows into the expansion unit 110. That is, a part of, for example, 50% of the refrigerant from the first sub-evaporating unit 150 flows into the first sub-expansion unit 171 through the first bypass pipe 155, thus being reduced in its temperature to −15° C. prior to flowing into the first sub-evaporating unit 150. Within the first sub-evaporating unit 150, the bypassed refrigerant of −15° C. absorbs heat from the refrigerant of 25° C. flowing from the outdoor unit 140, and so the temperature of the refrigerant flowing from the first sub-evaporating unit 150 to the expansion unit 110 is reduced from 25° C. to 5° C. The temperature of the bypassed refrigerant discharged from the first sub-evaporating unit 150 through the outlet port 153*b* is increased to 0° C.

The refrigerant of 5° C. flowing into the expansion unit 110 is adiabatically expanded within the expansion unit 110 to become low temperature, low pressure refrigerant of −15° C., and flows into the indoor unit 120. The refrigerant of −15° C. is increased in its temperature to 10° C. while passing through the indoor unit 120. Therefore, at the compressor 130, the refrigerant of 0° C. flowing from the refrigerant outlet port 153*b* of the first sub-evaporating unit 150 is mixed with the refrigerant of 10° C. flowing from the indoor unit 120 to form mixed refrigerant having a temperature of 0° C. 10° C., for example, 5° C., prior to flowing into the compressor 130.

In a heating mode operation of the system 100 of FIG. 2, the flow control valves 195*b*, 193*a*, 192*a* and 196*a* of the second compressor pipe 195, the second refrigerant pipe 193, the first refrigerant pipe 192 and the pipe 196 are opened, while the flow control valve 194*a* of the first compressor pipe 194 and the flow control valve 195*a* of the second compressor pipe 195 are closed.

At the outdoor unit 140, the refrigerant absorbs heat from air outside a target room to evaporate prior to flowing into the compressor 130 through the second refrigerant pipe 193, the first refrigerant pipe 192 and the first compressor pipe 194. The refrigerant is compressed at the compressor 130, and is discharged to the indoor unit 120 through the pipe 196. At the indoor unit 120, the refrigerant dissipates heat to air inside the room to be condensed. The refrigerant from the indoor unit 120 passes through the expansion unit 110 while being adiabatically expanded, and flows into the outdoor unit 140, thus finishing one cycle of the heating mode operation.

In the heating operation of the system 100, the flow control valve 165*a* of the second bypass pipe 165 branching from the second connection pipe 164 at the position in back of the expansion unit 110 is opened, while the flow control valve 155*a* of the first bypass pipe 155 branching from the first connection pipe 154 at the position in front of the expansion unit 110 is closed.

Therefore, the refrigerant flowing from the second sub-evaporating unit 160 to the expansion unit 110 partially flows into the second sub-expansion unit 172 through the second bypass pipe 165 to be expanded. At the second sub-evaporating unit 160, heat is transferred between the bypassed refrigerant flowing into the sub-evaporating unit 160 through the refrigerant inlet port 163*a* and the refrigerant flowing from the indoor unit 120 to the main expansion unit 110 through the second sub-evaporating unit 160.

In the heating operation of the system 100, the flow control valve 166*a* of the second low temperature refrigerant outlet pipe 166 is opened, while the flow control valve 156*a* of the first low temperature refrigerant outlet pipe 156 is closed.

Therefore, the refrigerant from the outlet port 163*b* of the second sub-evaporating unit 160 passes through the second low temperature refrigerant outlet pipe 166, the low temperature refrigerant supply pipe 191 and the first refrigerant pipe 192 prior to flowing into the first compressor pipe 194. Within the first compressor pipe 194, the refrigerant from the second sub-evaporating unit 160 is mixed with the refrigerant from the outdoor unit 140 prior to flowing into the compressor 130.

In such a case, since the flow control valve 155*a* of the first bypass pipe 155 is closed, the refrigerant flowing from the expansion unit 110 to the first sub-evaporating unit 150 simply flows to the outdoor unit 140 without being additionally processed.

During such a heating mode operation of the air conditioning system 100, the refrigerant flowing from the indoor unit 120 is reduced in its temperature from 25° C. to 5° C. while passing through the second sub-evaporating unit 160, and flows into the expansion unit 110. That is, a part of, for example, 50% of the refrigerant from the second sub-evaporating unit 160 flows into the second sub-expansion unit 172 through the second bypass pipe 165, thus being reduced in its temperature to −15° C. prior to flowing into the second sub-evaporating unit 160. Within the second sub-evaporating unit 160, the bypassed refrigerant of −15° C. absorbs heat from the refrigerant of 25° C. flowing from the indoor unit 120, and so the temperature of the refrigerant flowing from the second sub-evaporating unit 160 to the expansion unit 110 is reduced from 25° C. to 5° C. The temperature of the bypassed refrigerant discharged from the second sub-evaporating unit 160 through the outlet port 163*b* is increased to 0° C.

The refrigerant of 5° C. flowing into the expansion unit 110 is adiabatically expanded within the expansion unit 110 to become low temperature, low pressure refrigerant of −15° C., and flows into the outdoor unit 140. The refrigerant of −15° C. is increased in its temperature to 10° C. while passing through the outdoor unit 140. Therefore, at the compressor 130, the refrigerant of 0° C. flowing from the refrigerant outlet port 163*b* of the second sub-evaporating unit 160 is mixed with the refrigerant of 10° C. flowing from the outdoor unit 140 to form mixed refrigerant having a temperature of 0° C.~10° C., for example, 5° C., prior to flowing into the compressor 130.

The operational effect of the air conditioning system 200 according to the second embodiment will be described herein below with reference to FIGS. 4 and 5.

In a cooling mode operation of the system 200 of FIG. 4, the flow control valves 256*a*, 257*a* and 295*a* of the first high temperature refrigerant inlet pipe 256, the first low temperature refrigerant outlet pipe 257, the second compressor pipe 295 are opened, while the flow control valves 296*a*, 267*a* and 266*a* of the pipe 296, the second low temperature refrigerant outlet pipe 267 and the second high temperature refrigerant inlet pipe 266 are closed.

At the indoor unit 220, the refrigerant absorbs heat from air inside a target room to evaporate prior to flowing into the compressor 230 through the first high temperature refrigerant inlet pipe 256, the first low temperature refrigerant outlet pipe 257 and the first compressor pipe 294. The refrigerant is compressed at the compressor 230, and is discharged to the outdoor unit 240 through the second compressor pipe 295. At the outdoor unit 240, the refrigerant dissipates heat to atmospheric air outside the room to be condensed. The refrigerant from the outdoor unit 240 passes through the expansion unit 210 while being expanded, and flows into the indoor unit 220, thus finishing one cycle of the cooling mode operation.

In the cooling operation of the system 200, the flow control valve 255*a* of the first bypass pipe 255 branching from the first connection pipe 254 at a position in front of the expansion unit 210 is opened, while the flow control valve 265*a* of the second bypass pipe 265 branching from the second connection pipe 264 at a position in back of the expansion unit 210 is closed.

The refrigerant flowing from the first sub-evaporating unit 250 to the expansion unit 210 partially flows into the first sub-expansion unit 271 through the first bypass pipe 255 to be expanded. Therefore, at the first sub-evaporating unit 250, heat is transferred between the bypassed refrigerant flowing into the first sub-evaporating unit 250 through the refrigerant inlet ports 253*a* and 253*b* and the refrigerant flowing from the outdoor unit 240 to the main expansion unit 210 through the first sub-evaporating unit 250.

In addition, the bypassed refrigerant discharged from the first sub-evaporating unit 250 through the outlet port 253*c* flows into the first compressor pipe 294 through the first low temperature refrigerant outlet pipe 257, and flows into the compressor 230.

In such a case, since the flow control valve 265*a* of the second bypass pipe 265 is closed, the refrigerant flowing from the expansion unit 210 to the second sub-evaporating unit 260 simply flows to the indoor unit 220 without being additionally processed.

During such a cooling mode operation of the air conditioning system 200, the refrigerant flowing from the outdoor unit 240 is reduced in its temperature from 25° C. to 5° C. while passing through the first sub-evaporating unit 250, and flows into the expansion unit 210. In such a case, a part of, for example, 50% of the refrigerant from the first sub-evaporating unit 250 flows into the first sub-expansion unit 271 through the first bypass pipe 255, thus being reduced in its temperature to −15° C. prior to flowing into the first sub-evaporating unit 250. In addition, the refrigerant flowing into the expansion unit 210 is adiabatically expanded within the expansion unit 210 to become low temperature, low pressure refrigerant of −15° C., and flows into the indoor unit 220. The refrigerant of −15° C. is increased in its temperature to 10° C. while passing through the indoor unit 220. The refrigerant of 10° C. flows from the indoor unit 220 into the first sub-evaporating unit 250 through the first high temperature refrigerant inlet pipe 256. Within the first sub-evaporating unit 250, the refrigerant of 10° C. flowing from the indoor unit 220 is mixed with the bypassed refrigerant of −15° C. flowing from the first sub-expansion unit 271, thus forming mixed refrigerant. The mixed refrigerant absorbs heat from the refrigerant of 25° C. flowing from the outdoor unit 240, and so the temperature of the refrigerant flowing from the first sub-evaporating unit 250 to the expansion unit 210 is reduced from 25° C. to 5° C. Due to the heat exchanging action within the first sub-evaporating unit 250, the temperature of the mixed refrigerant becomes about 5° C. The mixed refrigerant of 5° C. flows from the refrigerant outlet port 253*c* of the first sub-evaporating unit 250, and passes through the first low temperature refrigerant outlet pipe 257, the low temperature refrigerant supply pipe 291 and the first compressor pipe 294 prior to flowing into the compressor 230.

In a heating mode operation of the system 200 of FIG. 5, the flow control valves 266*a*, 267*a* and 296*a* of the second high temperature refrigerant inlet pipe 266, the second low temperature refrigerant outlet pipe 267, the pipe 296 are opened, while the flow control valves 295*a*, 257*a* and 256*a* of the second compressor pipe 295, the first low temperature refrigerant outlet pipe 257 and the first high temperature refrigerant inlet pipe 256 are closed.

At the outdoor unit 240, the refrigerant absorbs heat from air outside a target room to evaporate prior to flowing into the compressor 230 through the second high temperature refrigerant inlet pipe 266, the second low temperature refrigerant outlet pipe 267 and the first compressor pipe 294. The refrigerant is compressed at the compressor 230, and is discharged to the indoor unit 220 through the pipe 296. At the indoor unit 220, the refrigerant dissipates heat to air inside the room to be condensed. The refrigerant from the indoor unit 220 passes through the expansion unit 210 while being expanded, and flows into the outdoor unit 240, thus finishing one cycle of the heating mode operation.

In the heating operation of the system 200, the flow control valve 265*a* of the second bypass pipe 265 branching from the second connection pipe 264 at the position in back of the expansion unit 210 is opened, while the flow control valve 255*a* of the first bypass pipe 255 branching from the first connection pipe 254 at the position in front of the expansion unit 210 is closed.

The refrigerant flowing from the second sub-evaporating unit 260 to the expansion unit 210 partially flows into the second sub-expansion unit 272 through the second bypass pipe 265 to be expanded. Therefore, at the second sub-evaporating unit 260, heat is transferred between the refrigerant flowing into the second sub-evaporating unit 260 through the refrigerant inlet ports 263*a* and 263*b* and the refrigerant flowing from the indoor unit 220 to the main expansion unit 210 through the second sub-evaporating unit 260.

In addition, the refrigerant discharged from the second sub-evaporating unit 260 through the outlet port 263*c* flows into the first compressor pipe 294 through the second low temperature refrigerant outlet pipe 267, and flows into the compressor 230.

In such a case, since the flow control valve 255*a* of the first bypass pipe 255 is closed, the refrigerant flowing from the expansion unit 210 to the first sub-evaporating unit 250 simply flows to the outdoor unit 240 without being additionally processed.

During such a heating mode operation of the air conditioning system 200, the refrigerant flowing from the indoor unit 220 is reduced in its temperature from 25° C. to 5° C. while passing through the second sub-evaporating unit 260, and flows into the expansion unit 210. In such a case, a part of, for example, 50% of the refrigerant from the second sub-evaporating unit 260 flows into the second sub-expansion unit 272 through the second bypass pipe 265, thus being reduced in its temperature to −15° C. prior to flowing into the second sub-evaporating unit 260. In addition, the refrigerant flowing into the expansion unit 210 is adiabatically expanded within the expansion unit 210 to become low temperature, low pressure refrigerant of −15° C., and flows into the outdoor unit 240. The refrigerant of −15° C. is increased in its temperature to 10° C. while passing through the outdoor unit 240. The refrigerant of 10° C. flows from the outdoor unit 240 into the second sub-evaporating unit 260 through the second high temperature refrigerant inlet pipe 266. Within the second sub-evaporating unit 260, the refrigerant of 10° C. flowing from the outdoor unit 240 is mixed with the bypassed refrigerant of −15° C. flowing from the second sub-expansion unit 272, thus forming mixed refrigerant. The mixed refrigerant absorbs heat from the refrigerant of 25° C. flowing from the indoor unit 220, and so the temperature of the refrigerant flowing from the second sub-evaporating unit 260 to the expansion unit 210 is reduced from 25° C. to 5° C. Due to the heat exchanging action within the second sub-evaporating unit 260, the temperature of the mixed refrigerant becomes about 5° C. The mixed refrigerant of 5° C. flows from the refrigerant outlet port 263*c* of the second sub-evaporating unit 260, and passes through the second low temperature refrigerant outlet pipe 267, the low temperature refrigerant supply pipe 291 and the first compressor pipe 294 prior to flowing into the compressor 230.

The operational effect of the air conditioning system 300 according to the third embodiment will be described herein below with reference to FIGS. 7 and 8.

In a cooling mode operation of the system 300 of FIG. 7, the flow control valves 399*a*, 398*a*, 392*a* and 395*a* of the sixth refrigerant pipe 399, fifth refrigerant pipe 398, first refrigerant pipe 392 and second compressor pipe 395 are opened, while the flow control valves 397*a*, 393*b*, 396*a* and 393*a* of the fourth refrigerant pipe 397, seventh refrigerant pipe 393B, third refrigerant pipe 396 and second refrigerant pipe 393A are closed.

At the indoor unit 320, the refrigerant absorbs heat from air inside a target room to evaporate prior to flowing into the compressor 330 through the sixth refrigerant pipe 399, fifth refrigerant pipe 398, first refrigerant pipe 392 and first compressor pipe 394. The refrigerant is compressed at the compressor 330, and is discharged to the outdoor unit 340 through the second compressor pipe 395. At the outdoor unit 340, the refrigerant dissipates heat to atmospheric air outside the room to be condensed. The refrigerant from the outdoor unit 340 passes through the expansion unit 310 while being expanded, and flows into the indoor unit 320, thus finishing one cycle of the cooling mode operation.

In the cooling operation of the system 300, the flow control valve 355*a* of the first bypass pipe 355 branching from the first connection pipe 354 at a position in front of the expansion unit 310 is opened, while the flow control valve 365*a* of the second bypass pipe 365 branching from the second connection pipe 364 at a position in back of the expansion unit 310 is closed.

The refrigerant flowing from the first sub-evaporating unit 350 to the expansion unit 310 partially flows into the first sub-expansion unit 371 through the first bypass pipe 355 to be expanded. Therefore, at the first sub-evaporating unit 350, heat is transferred between the bypassed refrigerant flowing into the first sub-evaporating unit 350 through the refrigerant inlet port 353*a* and the refrigerant flowing from the outdoor unit 340 to the main expansion unit 310 through the first sub-evaporating unit 350.

In such a case, the bypassed refrigerant discharged from the first sub-evaporating unit 350 through the outlet port 353*b* flows into the first refrigerant pipe 392 through the first low temperature refrigerant outlet pipe 356. In addition, the refrigerant from the indoor unit 320 passes through the expansion unit 310 to perform a heating exchanging action, and flows into the first refrigerant pipe 392 through the fifth refrigerant pipe 398, thus being mixed with the bypassed refrigerant flowing from the first sub-evaporating unit 350 within the first refrigerant pipe 392. The mixed refrigerant flows into the compressor 330 through the low temperature refrigerant supply pipe 391 and the first compressor pipe 394.

In such a case, since the flow control valve 365*a* of the second bypass pipe 365 is closed, the refrigerant flowing from the expansion unit 310 to the second sub-evaporating unit 360 simply flows to the indoor unit 320 without being additionally processed.

During such a cooling mode operation of the air conditioning system 300, the refrigerant flowing from the outdoor unit 340 is reduced in its temperature from 25° C. to 5° C. while passing through the first sub-evaporating unit 350, and flows into the expansion unit 310. In such a case, a part of, for example, 50% of the refrigerant from the first sub-evaporating unit 350 flows into the first sub-expansion unit 371 through the first bypass pipe 355, thus being reduced in its temperature to −15° C. prior to flowing into the first sub-evaporating unit 350. Within the first sub-evaporating unit 350, the bypassed refrigerant of −15° C. absorbs heat from the refrigerant of 25° C. flowing from the outdoor unit 340, and so the temperature of the refrigerant flowing from the first sub-evaporating unit 350 to the expansion unit 310 is reduced from 25° C. to 5° C. The temperature of the bypassed refrigerant discharged from the first sub-evaporating unit 350 through the outlet port 353*b* is increased to 0° C.

The refrigerant of 5° C. flowing into the expansion unit 310 is adiabatically expanded within the expansion unit 310 to become low temperature, low pressure refrigerant of −15° C., and flows into the indoor unit 320. The refrigerant of −15° C. is increased in its temperature to 10° C. while passing through the indoor unit 320. In addition, the refrigerant flowing from the indoor unit 320 into the expansion unit 310 is increased in its temperature to 15° C. since it absorbs heat from the refrigerant flowing from the first sub-evaporating unit 350 into the expansion unit 310. Therefore, at the compressor 330, the refrigerant of 0° C. flowing from the refrigerant outlet port 353*b* of the first sub-evaporating unit 350 is mixed with the refrigerant of 15° C. flowing from the expansion unit 310 to form mixed refrigerant having a temperature of 0° C.~15° C., for example, 5° C., prior to flowing into the compressor 330.

In a heating mode operation of the system 300 of FIG. 8, the flow control valves 397*a*, 393*b*, 396*a* and 393*a* of the fourth refrigerant pipe 397, seventh refrigerant pipe 393B, third refrigerant pipe 396 and second refrigerant pipe 393A are opened, while the flow control valves 399*a*, 398*a*, 392*a* and 395*a* of the sixth refrigerant pipe 399, fifth refrigerant pipe 398, first refrigerant pipe 392 and second compressor pipe 395 are closed.

At the outdoor unit 340, the refrigerant absorbs heat from air outside a target room to evaporate prior to flowing into the compressor 330 through the third refrigerant pipe 396, sixth refrigerant pipe 399, seventh refrigerant pipe 393B, second refrigerant pipe 393A, and first compressor pipe 394. The refrigerant is compressed at the compressor 330, and is discharged to the indoor unit 320 through the fourth refrigerant pipe 397. At the indoor unit 320, the refrigerant dissipates heat to air inside the room to be condensed. The refrigerant from the indoor unit 320 passes through the expansion unit 310 while being expanded, and flows into the outdoor unit 340, thus finishing one cycle of the heating mode operation.

In the heating operation of the system 300, the flow control valve 365*a* of the second bypass pipe 365 branching from the second connection pipe 364 at a position in front of the expansion unit 310 is opened, while the flow control valve 355*a* of the second bypass pipe 355 branching from the second connection pipe 354 at a position in back of the expansion unit 310 is closed.

The refrigerant flowing from the second sub-evaporating unit 360 to the expansion unit 310 partially flows into the second sub-expansion unit 372 through the second bypass pipe 365 to be expanded. Therefore, at the second sub-evaporating unit 360, heat is transferred between the bypassed refrigerant flowing into the second sub-evaporating unit 360 through the refrigerant inlet port 363*a* and the refrigerant flowing from the indoor unit 320 to the main expansion unit 310 through the second sub-evaporating unit 360.

In such a case, the bypassed refrigerant discharged from the second sub-evaporating unit 360 through the outlet port 363*b* flows into the second refrigerant pipe 393A through the second low temperature refrigerant outlet pipe 366. In addition, the refrigerant from the outdoor unit 340 passes through the expansion unit 310 to perform a heating exchanging action, and flows into the second refrigerant pipe 393A through the sixth refrigerant pipe 399, thus being mixed with the bypassed refrigerant flowing from the second sub-evaporating unit 360 within the second refrigerant pipe 393A. The mixed refrigerant flows into the compressor 330 through the second refrigerant pipe 393A and the first compressor pipe 394.

In such a case, since the flow control valve 355*a* of the first bypass pipe 355 is closed, the refrigerant flowing from the expansion unit 310 to the first sub-evaporating unit 350 simply flows to the outdoor unit 340 without being additionally processed.

During such a heating mode operation of the air conditioning system 300, the refrigerant flowing from the indoor unit 320 is reduced in its temperature from 25° C. to 5° C. while passing through the second sub-evaporating unit 360, and flows into the expansion unit 310. In such a case, a part of, for example, 50% of the refrigerant from the second sub-evaporating unit 360 flows into the second sub-expansion unit 372 through the second bypass pipe 365, thus being reduced in its temperature to −15° C. prior to flowing into the second sub-evaporating unit 360. Within the second sub-evaporating unit 360, the bypassed refrigerant of −15° C. absorbs heat from the refrigerant of 25° C. flowing from the indoor unit 320, and so the temperature of the refrigerant flowing from the second sub-evaporating unit 360 to the expansion unit 310 is reduced from 25° C. to 5° C. The temperature of the bypassed refrigerant discharged from the second sub-evaporating unit 360 through the outlet port 363*b* is increased to 0° C.

The refrigerant of 5° C. flowing into the expansion unit 310 is adiabatically expanded within the expansion unit 310 to become low temperature, low pressure refrigerant of −15° C., and flows into the outdoor unit 340. The refrigerant of −15° C. is increased in its temperature to 10° C. while passing through the outdoor unit 340. In addition, the refrigerant flowing from the outdoor unit 340 into the expansion unit 310 is increased in its temperature to 15° C. since it absorbs heat from the refrigerant flowing from the second sub-evaporating unit 360 into the expansion unit 310. Therefore, at the compressor 330, the refrigerant of 0° C. flowing from the refrigerant outlet port 363*b* of the second sub-evaporating unit 360 is mixed with the refrigerant of 15° C. flowing from the expansion unit 310 to form mixed refrigerant having a temperature of 0° C.~15° C., for example, 5° C., prior to flowing into the compressor 330.

The operational effect of the air conditioning system 400 according to the fourth embodiment will be described herein below with reference to FIGS. 10 and 11.

In a cooling mode operation of the system 400 of FIG. 10, the flow control valves 493*a*, 456*a*, 457*a* and 495*a* of the second refrigerant pipe 493, first high temperature refrigerant inlet pipe 456, first low temperature refrigerant outlet pipe 457, second compressor pipe 495 are opened, while the flow control valves 466*a*, 492*a*, 467*a* and 496*a* of the second high temperature refrigerant inlet pipe 466, first refrigerant pipe 492, second low temperature refrigerant outlet pipe 467 and the third refrigerant pipe 496 are closed.

At the indoor unit 420, the refrigerant absorbs heat from air inside a target room to evaporate prior to flowing into the compressor 430 through the second refrigerant pipe 493, first high temperature refrigerant inlet pipe 456, first low temperature refrigerant outlet pipe 457, low temperature refrigerant supply pipe 491 and first compressor pipe 494. The refrigerant is compressed at the compressor 430, and is discharged to the outdoor unit 440 through the second compressor pipe 495. At the outdoor unit 440, the refrigerant dissipates heat to atmospheric air outside the room to be condensed. The refrigerant from the outdoor unit 440 passes through the expansion unit 410 while being expanded, and flows into the indoor unit 420, thus finishing one cycle of the cooling mode operation.

In the cooling operation of the system 400, the flow control valve 455*a* of the first bypass pipe 455 branching from the first connection pipe 454 at a position in front of the expansion unit 410 is opened, while the flow control valve 465*a* of the second bypass pipe 465 branching from the second connection pipe 464 at a position in back of the expansion unit 410 is closed.

The refrigerant flowing from the first sub-evaporating unit 450 to the expansion unit 410 partially flows into the first sub-expansion unit 471 through the first bypass pipe 455 to be expanded. Therefore, at the first sub-evaporating unit 450, heat is transferred between the bypassed refrigerant flowing into the first sub-evaporating unit 450 through the refrigerant inlet ports 453*a* and 453*b* and the refrigerant flowing from the outdoor unit 440 to the main expansion unit 410 through the first sub-evaporating unit 450. That is, the high temperature refrigerant, flowing from the indoor unit 420 and passing through the expansion unit 410 while performing a heating exchanging action, flows into the first sub-evaporating unit 450, and is mixed with the bypassed low temperature refrigerant flowing from the first sub-expansion unit 471 to form mixed refrigerant. Within the first sub-evaporating unit 450, heat is transferred between the mixed refrigerant and the refrigerant flowing from the outdoor unit 440.

The mixed refrigerant is, thereafter, discharged from the first sub-evaporating unit 450 through the outlet port 453*c*, and passes through the first low temperature refrigerant outlet pipe 457 and the first compressor pipe 494 prior to flowing into the compressor 430.

In such a case, since the flow control valve 465*a* of the second bypass pipe 465 is closed, the refrigerant flowing from the expansion unit 410 to the second sub-evaporating unit 460 simply flows to the indoor unit 420 without being additionally processed.

During such a cooling mode operation of the air conditioning system 400, the refrigerant flowing from the outdoor unit 440 is reduced in its temperature from 25° C. to 5° C. while passing through the first sub-evaporating unit 450, and flows into the expansion unit 410. In such a case, a part of, for example, 50% of the refrigerant from the first sub-evaporating unit 450 flows into the first sub-expansion unit 471 through the first bypass pipe 455, thus being reduced in its temperature to −15° C. prior to flowing into the first sub-evaporating unit 450. In addition, the refrigerant flowing into the expansion unit 410 is adiabatically expanded within the expansion unit 410 to become low temperature, low pressure refrigerant of −15° C., and flows into the indoor unit 420. The refrigerant of −15° C. is increased in its temperature to 10° C. while passing through the indoor unit 420. The refrigerant of 10° C. flows from the indoor unit 420 into the expansion unit 410 through the second refrigerant pipe 493, and is increased in its temperature to 15° C. while passing through the expansion unit 310, and flows into the first sub-evaporating unit 450 through the first high temperature refrigerant inlet pipe 456. Within the first sub-evaporating unit 450, the refrigerant of 15° C. flowing from the expansion unit 410 is mixed with the bypassed refrigerant of −15° C. flowing from the first sub-expansion unit 471, thus forming mixed refrigerant. The mixed refrigerant absorbs heat from the refrigerant of 25° C. flowing from the outdoor unit 440, and so the temperature of the refrigerant flowing from the first sub-evaporating unit 450 to the expansion unit 410 is reduced from 25° C. to 5° C. Due to the heat exchanging action within the first sub-evaporating unit 450, the temperature of the mixed refrigerant becomes about 5° C. The mixed refrigerant of 5° C. flows from the refrigerant outlet port 453*c* of the first sub-evaporating unit 450, and passes through the first low temperature refrigerant outlet pipe 457, the low temperature refrigerant supply pipe 491 and the first compressor pipe 494 prior to flowing into the compressor 430.

In a heating mode operation of the system 400 of FIG. 11, the flow control valves 492*a*, 466*a*, 467*a* and 496*a* of the first refrigerant pipe 492, second high temperature refrigerant inlet pipe 466, second low temperature refrigerant outlet pipe 467 and the third refrigerant pipe 496 are opened, while the flow control valves 495*a*, 456*a*, 493*a* and 457*a* of the second compressor pipe 495, first high temperature refrigerant inlet pipe 456, second refrigerant pipe 493 and first low temperature refrigerant outlet pipe 457 are closed.

At the outdoor unit 440, the refrigerant absorbs heat from atmospheric air outside a target room to evaporate prior to flowing into the compressor 430 through the first refrigerant pipe 492, second high temperature refrigerant inlet pipe 466, second low temperature refrigerant outlet pipe 467, low temperature refrigerant supply pipe 491 and first compressor pipe 494. The refrigerant is compressed at the compressor 430, and is discharged to the indoor unit 420, through the third refrigerant pipe 496. At the indoor unit 420, the refrigerant dissipates heat to air inside the room to be condensed. The refrigerant from the indoor unit 420 passes through the expansion unit 410 while being expanded, and flows into the outdoor unit 440, thus finishing one cycle of the heating mode operation.

In the heating operation of the system 400, the flow control valve 465*a* of the second bypass pipe 465 branching from the second connection pipe 464 at a position in front of the expansion unit 410 is opened, while the flow control valve 455*a* of the first bypass pipe 455 branching from the first connection pipe 454 at a position in back of the expansion unit 410 is closed.

The refrigerant flowing from the second sub-evaporating unit 460 to the expansion unit 410 partially flows into the second sub-expansion unit 472 through the second bypass pipe 465 to be expanded. Therefore, at the second sub-evaporating unit 460, heat is transferred between the bypassed refrigerant flowing into the second sub-evaporating unit 460 through the refrigerant inlet ports 463*a* and 463*b* and the refrigerant flowing from the indoor unit 420 to the main expansion unit 410 through the second sub-evaporating unit 460. That is, the high temperature refrigerant, flowing from the outdoor unit 440 and passing through the expansion unit 410 while performing a heating exchanging action, flows into the second sub-evaporating unit 460, and is mixed with the bypassed low temperature refrigerant flowing from the second sub-expansion unit 472 to form mixed refrigerant. Within the second sub-evaporating unit 460, heat is transferred between the mixed refrigerant and the refrigerant flowing from the indoor unit 420.

The mixed refrigerant is, thereafter, discharged from the second sub-evaporating unit 460 through the outlet port 463*c*, and passes through the second low temperature refrigerant outlet pipe 467 and the first compressor pipe 494 prior to flowing into the compressor 430.

In such a case, since the flow control valve 455*a* of the first bypass pipe 455 is closed, the refrigerant flowing from the expansion unit 410 to the first sub-evaporating unit 450 simply flows to the outdoor unit 440 without being additionally processed.

During such a heating mode operation of the air conditioning system 400, the refrigerant flowing from the indoor unit 420 is reduced in its temperature from 25° C. to 5° C. while passing through the second sub-evaporating unit 460, and flows into the expansion unit 410. In such a case, a part of, for example, 50% of the refrigerant from the second sub-evaporating unit 460 flows into the second sub-expansion unit 472 through the second bypass pipe 465, thus being reduced in its temperature to −15° C. prior to flowing into the second sub-evaporating unit 460. In addition, the refrigerant flowing into the expansion unit 410 is adiabatically expanded within the expansion unit 410 to become low temperature, low pressure refrigerant of −15° C., rind flows into the outdoor unit 440. The refrigerant of −15° C. is increased in its temperature to 10° C. while passing through the outdoor unit 440. The refrigerant of 10° C. flows from the outdoor unit 440 into the expansion unit 410 through the first refrigerant pipe 492, and is increased in its temperature to 15° C. while passing through the expansion unit 410, and flows into the second sub-evaporating unit 460 through the second high temperature refrigerant inlet pipe 466. Within the second sub-evaporating unit 460, the refrigerant of 15° C. flowing from the expansion unit 410 is mixed with the bypassed refrigerant of −15° C. flowing from the second sub-expansion unit 472, thus forming mixed refrigerant. This mixed refrigerant absorbs heat from the refrigerant of 25° C. flowing from the indoor unit 420, and so the temperature of the refrigerant flowing from the second sub-evaporating unit 460 to the expansion unit 410 is reduced from 25° C. to 5° C. Due to the heat exchanging action within the second sub-evaporating unit 460, the temperature of the mixed refrigerant becomes about 5° C. The mixed refrigerant of 5° C. flows from the refrigerant outlet port 463*c* of the second sub-evaporating unit 460, and passes through the second low temperature refrigerant outlet pipe 467, the low temperature refrigerant supply pipe 491 and the first compressor pipe 494 prior to flowing into the compressor 430.

INDUSTRIAL APPLICABILITY

As described above, the present invention provides an air conditioning system with low compression load. This air conditioning system is designed to prevent the temperature of the inlet refrigerant of its compressor from being increased excessively to exceed the saturation point of the refrigerant with both a gas phase portion and a liquid phase portion of the refrigerant. This air conditioning system thus preferably reduces the compression load of the compressor.

The compressor of this air conditioning system is effectively usable for a desired lengthy period of time without being thermally damaged or broken, and so it allows a user to conveniently use the air conditioning system without consuming excessive time or labor for repairing the compressor.

The compressor of this air conditioning system also optimally compresses the refrigerant during an operation of the air conditioning system, thus being free from a reduction in its heating and/or cooling efficiency.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An air conditioning system, comprising an expansion unit used for adiabatically expanding refrigerant, an indoor unit having a heat exchanger, a compressor used for adiabatically compressing the refrigerant, and an outdoor unit having a heat exchanger, and sequentially circulating the refrigerant through the compressor, outdoor unit, expansion unit, and indoor unit to heat or cool a target area using a phase change of the refrigerant, wherein condensed refrigerant from the indoor unit or the outdoor unit passes through a heat exchanging, sub-evaporating unit prior to flowing into the expansion unit, with the refrigerant from said sub-evaporating unit partially flowing into a sub-expansion unit to be adiabatically expanded to become low temperature, low pressure bypassed refrigerant prior to flowing into the compressor through the sub-evaporating unit, wherein the heat exchanging, sub-evaporating unit includes a first heat exchanging, sub-evaporating unit (150) having a heat exchanger (152) mounted in a housing (151) and a second heat exchanging sub-evaporating unit (160) having heat exchanger (162) mounted in a housing (161), the expansion unit (110) has a first opening in fluid communication with first opening of the heat exchanger (152) of the first heat exchanging, sub-evaporating unit (150) and has a second opening in fluid communication with first opening of heat exchanger (162) of the second heat exchanging, sub-evaporating unit (160);

a first sub-expansion unit (171) having a first opening in fluid communication with first opening of a first flow control valve (155*a*) and having a second opening in fluid communication with the housing (151) of the first heat exchanging, sub-evaporating unit (150), the first control valve (155*a*) having a second opening in communication with the first opening of the expansion unit (110) and the first opening of the heat exchanger (152) of the first heat exchanging, sub-evaporating unit (150);

a second sub-expansion unit (172) having a first opening in fluid communication with the first opening of a second flow control valve (165*a*) and a second opening in fluid communication with the housing (161) of the second heat exchanging, sub-evaporating unit (160), the second valve (165*a*) having a second opening in fluid communication with the second opening of the expansion unit (110) and the first opening of the heat exchanger (162) of the second heat exchanging, sub-evaporating unit (160);

a second opening of the heat exchanger (152) of the first heat exchanging, sub-evaporating unit (150) in fluid communication with the outdoor unit (140) and second opening of the heat exchanger (162) of the second heat exchanging, sub-evaporating unit (160) in fluid communication with the indoor unit (120);

the housing (151) of the first heat exchanging, sub-evaporating unit (150) in fluid communication with first opening of a third flow control valve (156*a*) and the housing (161) of the second heat exchanging, sub-evaporating unit (160) in fluid communication with first opening of a fourth flow control valve (166*a*), a second opening of the third and fourth valves (156*a* and 166*a*) in fluid communication with first opening of a fifth flow control valve (192*a*) and first opening of sixth flow control valve (193*a*) with second opening of the sixth valve (193*a*) in fluid communication with first opening of a seventh flow control valve (195*a*) and first opening of an eighth flow control valve (195*b*) with second opening of the eighth control valve (195*b*) in fluid communication with the outdoor unit (140);

second opening of the seventh control valve (195*a*) in fluid communication with the first opening of the compressor (130) and with first opening of a ninth flow control valve (196*a*);

second opening of the fifth flow control valve (192*a*) in fluid communication with first opening of a tenth flow control valve (194*a*) and with a second opening of the compressor (130); and a second opening of the tenth flow control valve (194*a*) in fluid communication with second opening of the ninth flow control valve (196*a*) and with the indoor unit (120), wherein when the system is in the cooling mode the first valve (155*a*), the third valve (156*a*), the fifth valve (192*a*), the seventh valve (195*a*), the eighth valve (195*b*) and the tenth valve (194*a*) are in an open position to pass refrigerant therethrough and the second valve (165*a*), the fourth valve (166*a*), the sixth valve (193*a*) and the ninth valve (196*a*) are in the closed position to prevent refrigerant from moving therethrough and when the system is in the heating mod the second valve (165*a*), the fourth valve (166*a*), the sixth valve (193*a*), and the ninth valve (196*a*) are in the open position to pass refrigerant therethrough and the first valve (155*a*), the third valve (156*a*), the fifth valve (192*a*), the seventh valve (195*a*), the eighth valve (195*b*), and the tenth valve (194*a*) are in the closed position to prevent refrigerant from moving therethrough.

2. The air conditioning unit according to claim 1, wherein the first heat exchanging, sub-evaporating unit (150, now designated 150') includes a first heat exchanger unit (150A)

and a second heat exchanger unit (150B), the second heat exchanging, sub-evaporating unit (160, now designated 160') includes a first heat exchanger unit (160A) and a second heat exchanger unit (160B), the expansion unit (110, now designated 110') includes a first sub unit (110A) and a second sub unit (110B), the first sub-expansion unit (171, now designated 171') includes a first sub unit (171A) and a second sub unit (171B), and the second sub-expansion unit (172, now designated 172') includes first sub unit (172A) and a second sub unit (172B), and wherein the compressor (130, now designated 130') includes a first chamber (130A) and a second chamber (130B);

the first opening of the first control valve (155*a*) is in fluid communication with first opening of the first sub unit (171A) of the first sub-expansion unit (171') and second opening of the first sub unit (171A) of the first sub-expansion unit (171') is in fluid communication with first opening of the second sub unit (171B) of the first sub-expansion unit (171');

the second opening of the first valve (155*a*) is in fluid communication with first opening of the first heat exchanger unit (150A) of the first heat exchanging, sub-evaporating unit (150') and first opening of the second sub-expansion unit (110B) of the expansion unit (110'), second opening of the first heat exchanger unit (150A) of the first heat exchanging, sub-evaporating unit (150') is in fluid communication with first opening of the second heat exchanger unit (150B) of the first heat exchanging, sub-evaporating unit (150'), second opening of the second heat exchanger unit (150B) of the first heat exchanging, sub-evaporating unit (150') is in fluid communication with the outdoor unit (140);

second opening of the second sub unit (171B) of the first sub-expansion unit (171') is in fluid communication with housing of the first heat exchanger unit (150A) of the first heat exchanging, sub-evaporating unit (150');

housing of the second heat exchanger unit (150B) of the first heat exchanging, sub-evaporating unit (150') is in fluid communication with the first opening of the third valve (156*a*);

second opening of the second sub unit (110B) of the expansion unit (110') is in fluid communication with first opening of the first sub-expansion unit (110A) of the expansion unit (110), second opening of the first sub unit (110A) of the expansion unit (110') is in fluid communication with the second opening of the second valve (165*a*) and first opening of the second heat exchanger unit (160B) of the second heat exchanging, sub-evaporating unit (160');

the first opening of the valve (165*a*) is in fluid communication with the first opening of the second sub unit (172B) of the second sub-expansion unit (172') and second opening of the second sub unit (172B) of the second sub-expansion unit (172') is in fluid communication with the first opening of the first sub unit (172A) of the second sub-expansion unit (172'), second opening of the first sub unit (172A) of the second sub-expansion unit (172') is in fluid communication with housing of the second heat exchanger unit (160B) of the second heat exchanging, sub-evaporating unit (160');

second opening of the second heat exchanger unit (160B) of the second heat exchanging, sub-evaporating unit (160') is in fluid communication with the first opening of the first heat exchanger unit (160A) of the second heat exchanging, sub-evaporating unit (160'), second opening of the first heat exchanger unit (160A) of the second heat exchanging, sub-evaporating unit (160') is in fluid communication with the indoor unit (120);

the first opening of the fourth valve (166*a*) is in fluid communication with housing of the first heat exchanger unit (160A) of the second heat exchanging, sub-evaporating unit (160'); and the first chamber (130A) of the compressor (130') is in fluid communication with the second opening of the seventh control valve (195*a*) and the first opening of the ninth control valve (196*a*) and the second chamber (130B) of the compressor (130') is in fluid communication with the second opening of the fifth control valve and the first opening of the tenth control valve.

3. An air conditioning system, comprising an expansion unit used for adiabatically expanding refrigerant, an indoor unit having a heat exchanger, a compressor used for adiabatically compressing the refrigerant, and an outdoor unit having a heat exchanger, and sequentially circulating the refrigerant through the compressor, outdoor unit, expansion unit, and indoor unit to heat or cool a target area using a phase change of the refrigerant, wherein condensed refrigerant from the indoor unit or the outdoor unit passes through a heat exchanging, sub-evaporating unit prior to flowing into the expansion unit, with the refrigerant from said sub-evaporating unit partially flowing into a sub-expansion unit to be adiabatically expanded to become low temperature, low pressure bypassed refrigerant, and both the bypassed refrigerant flowing from the sub-expansion unit and the refrigerant flowing from the outdoor unit or the indoor unit commonly passing through the sub-evaporating unit prior to flowing into the compressor, wherein the heat exchanging, sub-evaporating unit includes a first heat exchanging, sub-evaporating unit (250) having a heat exchanger (252) mounted in a housing (251) and a second heat exchanging, sub-evaporating unit (260) having a heat exchanger (262) mounted in a housing (261), the expansion unit (210) has a first opening in fluid communication to first opening of the heat exchanger (252) of the first heat exchanging, sub-evaporating unit (250) and has a second opening in fluid communication with first opening of the heat exchanger (262) of the second heat exchanging, sub-evaporating unit (260);

a first opening of a first sub-expansion unit (271) in fluid communication with a first opening of a first fluid control valve (255*a*), with second opening of the first fluid control valve (255*a*) in fluid communication with the first opening of the expansion unit (210) and the first opening of the heat exchanger (252) of the first heat exchanging, sub-evaporating unit (250) with second opening of the first sub-expansion unit (271) in fluid communication with the housing (251) of the first heat exchanging, sub-evaporating unit (250);

first opening of second sub-expansion unit (272) in fluid communication with first opening of a second flow control valve (265*a*) with second opening of the second flow control valve (265*a*) in fluid communication with the second opening of the expansion unit (210) and the first opening of the heat exchanger (262) of the second heat exchanging, sub-evaporating unit (260) with second opening of the sub-expansion unit (272) in fluid communication with the housing (261) of the second heat exchanging, sub-evaporating unit (260);

second opening of the heat exchanger (252) of the first heat exchanging, sub-evaporating unit (250) in fluid communication with the outdoor unit (240);

second opening of the heat exchanger (262) of the second heat exchanging, sub-evaporating unit (260) in fluid communication with the indoor unit (220);

the housing (251) of the first heat exchanging, sub-evaporating unit (250) in fluid communication with first opening of a third flow control valve (256*a*) and with first opening of a fourth fluid control valve (257*a*);

the housing (261) of the second heat exchanging, sub-evaporating unit (260) in fluid communication with first opening of a fifth flow control valve (266*a*) and with first opening of a sixth flow control valve (267*a*), second opening of the fourth and sixth valves (257*a* and 267*a*) in fluid communication with first opening of the compressor (230); and second opening of the fifth control valve (266*a*) in fluid communication with first opening of seventh flow control value (295*a*) and the outdoor unit (240), second opening of the seventh control valve (295*a*) in fluid communication with second opening of the compressor (230) and first opening of eighth flow control valve (296*a*), second opening of the eighth flow control valve (296*a*) in fluid communication with the indoor unit (220) and second opening of third control valve (256*a*), wherein when the system is in the cooling mode the first valve (255*a*), the third valve (256*a*), the fourth valve (257*a*), and the seventh valve (295*a*) are in an open position to pass refrigerant therethrough and the second valve (265*a*), the fifth valve (266*a*), the sixth valve (267*a*), and the eighth valve (296*a*) are in the closed position to stop refrigerant from moving therethrough and when the system is in the heating mode the second valve (265*a*), the fifth valve (266*a*), the sixth valve (267*a*), and the eighth valve (296*a*) are in the open position to pass refrigerant and the first valve (255*a*), the third valve (256*a*), the fourth valve (257*a*), and the seventh valve (296*a*) are in the closed position to stop refrigerant from moving therethrough.

4. The air conditioning unit according to claim 3, wherein the first heat exchanging, sub-evaporating unit (250, now designated 250') includes a first heat exchanger unit (250A) and a second heat exchanger unit (250B), the second heat exchanging, sub-evaporating unit (260, now designated 260') includes a first heat exchanger unit (260A) and a second heat exchanger unit (260B), the expansion unit (210, now designated 210') includes a first sub unit (210A) and a second sub unit (210B), the first sub-expansion unit (271, now designated 271') includes a first sub unit (271A) and a second sub unit (271B), the second sub-expansion unit (272, now designated 272') includes a first sub unit (272A) and a second sub unit (272B), and the compressor (230, now designated 230') includes a first chamber (230A) and a second chamber (230B), wherein the first opening of the first control valve (255*a*) is in fluid communication with first opening of the second sub unit (271B) of the first sub-expansion unit (271'), and second opening of the second sub unit (271A) of the first sub-expansion unit (171') is in fluid communication with first opening of the first sub unit (271A) of the first sub-expansion unit (271);

the second opening of the first valve (255*a*) is in fluid communication with first opening of the second heat exchanger unit (250B) of the first heat exchanging, sub-evaporating unit (250') and first opening of the first sub unit (210A) of the expansion unit (210');

second opening of the second heat exchanger unit (250B) of the first heat exchanging, sub-evaporating unit (250') is in fluid communication with first opening of the first heat exchanger unit (250A) of the first heat exchanging, sub-evaporating unit (250') with second opening of the first heat exchanger unit (250A) of the first heat exchanging, sub-evaporating unit (250') in fluid communication with the outdoor unit (240);

second opening of the first sub unit (271A) of the first sub-expansion unit (271') is in fluid communication with housing of the second heat exchanger unit (250B) of the first heat exchanging, sub-evaporating unit (250') with the housing of the second heat exchanger unit (250B) of the first heat exchanging, sub-evaporating unit (250') in fluid communication with the first opening of the third valve (256*a*);

housing of the first heat exchanger unit (250A) of the first heat exchanging, sub-evaporating unit (250') is in fluid communication with the first opening of the fourth valve (257*a*);

second opening of the first sub unit (210A) of the expansion unit (210') is in fluid communication with first opening of the second sub unit (210B) of the expansion unit (210');

second opening of the second sub unit (210B) of the expansion unit (210') is in fluid communication with the second opening of the second valve (265*a*) and first opening of the first heat exchanger unit (260A) of the second heat exchanging, sub-evaporating unit (260');

the first opening of the valve (265*a*) is in fluid communication with the first opening of the first sub unit (272A) of the second sub-expansion unit (272') with second opening of the first sub unit (272A) of the second sub-expansion unit (272') in fluid communication with the first opening of the second sub unit (272B) of the second sub-expansion unit (272') with second opening of the second sub unit (272B) of the second sub-expansion unit (272') in fluid communication with the housing of the first heat exchanger unit (260A) of the second heat exchanging, sub-evaporating unit (260');

second opening of the first heat exchanger unit (260A) of the second heat exchanging, sub-evaporating unit (260') is in fluid communication with the first opening of the second heat exchanger unit (260B) of the second heat exchanging, sub-evaporating unit (260'), with second opening of the second heat exchanger unit (260B) of the second heat exchanging, sub-evaporating unit (260') in fluid communication with the indoor unit (220);

the first opening of the fifth valve (266*a*) is in fluid communication with the housing of the first heat exchanger unit (260A) of the second heat exchanging, sub-evaporating unit (260'), the first opening of the sixth valve (267*a*) is in fluid communication with the housing of the second heat exchanger unit (260B) of the second heat exchanging, sub-evaporating unit (260'); and the first chamber (230A) of the compressor (230') is in fluid communication with the second opening of the fourth and sixth control valves (257*a* and 267*a*) and the second chamber (130B) of the compressor (230') is in fluid communication with the second opening of the seventh control valve (295*a*) and the first opening of the eighth control valve (296*a*).

5. An air conditioning system, comprising an expansion unit used for adiabatically expanding refrigerant, an indoor unit having a heat exchanger, a compressor used for adiabatically compressing the refrigerant, and an outdoor unit having a heat exchanger, and sequentially circulating the refrigerant through the compressor, outdoor unit, expansion unit, and indoor unit to heat or cool a target area using a phase change of the refrigerant, wherein condensed refrigerant from the indoor unit or the outdoor unit passes through a heat exchanging, sub-evaporating unit prior to flowing into the expansion unit, with the refrigerant from the sub-evaporating unit partially flowing into a sub-expansion unit to be adiabatically expanded to become low temperature, low pressure bypassed refrigerant, and both the bypassed refrigerant flowing from the sub-expansion unit and passing through the sub-evaporating unit and the refrigerant flowing from the outdoor unit or the indoor unit and passing through the expansion unit commonly flowing into the compressor, wherein the heat exchanging, sub-evaporating unit includes a first heat exchanging, sub-evaporating unit (350) having a heat exchanger (352) mounted in a housing (351) and a second heat exchanging, sub-evaporating unit (360) having a heat exchanger (362) mounted in a housing (361), the expansion unit (310) has a first opening in fluid communication to first opening of the heat exchanger (352) of the first heat exchanging, sub-evaporating unit (350) and has a second opening in fluid communication with first opening of the heat exchanger (362) of the second heat exchanging, sub-evaporating unit (360);

first opening of a first sub-expansion unit (371) in fluid communication with a first opening of a first flow control valve (355*a*), with second opening of the first flow control valve (355*a*) in fluid communication with the first opening of the expansion unit (310) and the first opening of the heat exchanger (352) of the first heat exchanging, sub-evaporating unit (350) with second opening of the first sub-expansion unit (371) in fluid communication with the housing (351) of the first heat exchanging, sub-evaporating unit (350);

first opening of a second sub-expansion unit (372) in fluid communication with first opening of a second flow control valve (365*a*) with second opening of the second flow control valve (365*a*) in fluid communication with the second opening of the expansion unit (310) and the first opening of the heat exchanger (362) of the second heat exchanging, sub-evaporating unit (360) with second opening of the sub-expansion unit (372) in fluid communication with the housing (361) of the second heat exchanging, sub-evaporating unit (360);

second opening of the heat exchanger (352) of the first heat exchanging, sub-evaporating unit (350) is in fluid communication with the outdoor unit (340), second opening of the heat exchanger (362) of the second heat exchanging, sub-evaporating unit (360) is in fluid communication with the indoor unit (320);

the housing (351) of the first heat exchanging, sub-evaporating unit (350) is in fluid communication with first opening of a third flow control valve (398*a*) and first opening of a fourth flow control valve (92*a*), with the second opening of the third valve (398*a*) in fluid communication with the housing of the expansion unit (310) and first opening of a fifth flow control valve (396*a*), with second opening of the fifth control valve (396*a*) in fluid communication with the outdoor unit (340) and first opening of sixth flow control valve (395*a*);

second opening of the sixth control valve (395*a*) in fluid communication with first opening of the compressor (330) and first opening of seventh flow control valve (397*a*), with second opening of the seventh control valve (397*a*) in fluid communication with the indoor unit (320) and first opening of the eighth flow control valve (399*a*);

second opening of the eighth control valve (399*a*) in fluid communication with the housing of the expansion unit (310) and first opening of ninth flow control valve (393*b*);

second opening of the ninth control valve (393*b*) in fluid communication with the housing (361) of the second heat exchanging, sub-evaporating unit (360) and first opening of tenth flow control valve (393*a*); and second opening of the tenth control valve (393*a*) in fluid communication with the second opening of the compressor (330) and the second opening of the fourth control valve (392*a*), wherein when the system is in the cooling mode the first valve (355*a*), the third valve (398*a*), the fourth valve (392*a*), the sixth valve (395*a*), and the eighth valve (399*a*) are in an open position to pass refrigerant therethrough and the second valve (365*a*), the fifth valve (396*a*), the seventh valve (397*a*), the ninth valve (393*b*), and the tenth valve (393*a*) are in the closed position to stop refrigerant from moving therethrough and when the system is in the heating mode the second valve (365*a*), the fifth valve (396*a*), the seventh valve (397*a*), the ninth valve (393*b*), and the tenth valve (393*a*) are in the open position to pass refrigerant and the first valve (355*a*), the third valve (398*a*), the fourth valve (392*a*), the sixth valve (395*a*), and the eighth valve (399*a*) are in the closed position to stop refrigerant from moving therethrough.

6. The air conditioning unit according to claim 5, wherein the first heat exchanging, sub-evaporating unit (350, now designated 350') includes a first heat exchanger unit (350A) and a second heat exchanger unit (350B), the second heat exchanging, sub-evaporating unit (360, now designated 360') includes a first heat exchanger unit (360A) and a second heat exchanger unit (360B), the expansion unit (310, now designated 310') includes a first sub unit (310A) and a second sub unit (310B), the first sub-expansion unit (371, now designated 371') includes a first sub unit (371A) and a second sub unit (371B), the second sub-expansion unit (372, now designated 372') includes a first sub unit (372A) and a second sub unit (372B), and the compressor (330, now designated 330') includes a first chamber (330A) and a second chamber (330B), wherein the first opening of the first control valve (355*a*) is in fluid communication with first opening of the second sub unit (371B) of the first sub-expansion unit (371') and second opening of the second sub unit (371A) of the first sub-expansion unit (371') is in fluid communication with first opening of the first sub unit (371A) of the first sub-expansion unit (371');

the second opening of the first valve (355*a*) is in fluid communication with first opening of the second heat exchanger unit (350B) of the first heat exchanging, sub-evaporating unit (350') and first opening of the first sub unit (310A) of the expansion unit (310');

second opening of the second heat exchanger unit (350B) of the first heat exchanging, sub-evaporating unit (350') is in fluid communication with first opening of the first heat exchanger unit (350A) of the first heat exchanging, sub-evaporating unit (350') with second opening of the first heat exchanger unit (350A) of the first heat exchanging, sub-evaporating unit (350') in fluid communication with the outdoor unit (340);

second opening of the first sub unit (371A) of the first sub-expansion unit (371') is in fluid communication with housing of the second heat exchanger unit (350B) of the first heat exchanging, sub-evaporating unit (350');

housing of the first heat exchanger unit (350A) of the first heat exchanging, sub-evaporating unit (350') is n fluid communication with the first opening of the third valve (398*a*) and with the first opening of the fourth valve (392*a*);

second opening of the first sub unit (310A) of the expansion unit (310') is in fluid communication with first opening of the second sub unit (310B) of the expansion unit (310'), with second opening of the second sub unit (310B) of the expansion unit (310') in fluid communication with the second opening of the second valve (365*a*) and first opening of the first heat exchanger unit (360A) of the second heat exchanging, sub-evaporating unit (360');

the first opening of the valve (365*a*) is in fluid communication with the first opening of the first sub unit (372A) of the second sub-expansion unit (372') with second opening of the first sub unit (372A) of the second sub-expansion unit (372') in fluid communication with the first opening of the second sub unit (372B) of the second sub-expansion unit (372'), with second opening of the second sub unit (372B) of the second sub-expansion unit (372') in fluid communication with housing of the first heat exchanger unit (360A) of the second heat exchanging, sub-evaporating unit (360');

second opening of the first heat exchanger unit (360A) of the second heat exchanging, sub-evaporating unit (360') is in fluid communication with the first opening of the second heat exchanger unit (360B) of the second heat exchanging, sub-evaporating unit (360'), with second opening of the second heat exchanger unit (360B) of the second heat exchanging, sub-evaporating unit (360') in fluid communication with the indoor unit (320);

the first opening of the tenth valve (393*a*) and the second opening of the ninth valve (393*b*) are in fluid communication with the housing of the second heat exchanger unit (360A) of the second heat exchanging, sub-evaporating unit (360');

the first opening of the tenth valve (393*a*) and the second opening of the eighth valve (399*a*) are in fluid communication with the housing of the second sub-expansion unit (310B) of the expansion unit (310');

the first opening of the fifth valve (396*a*) and the second opening of the third valve (398*a*) are in fluid communication with the housing of the first sub-expansion unit (310A) of the expansion unit (310'); and the first chamber (330A) of the compressor (330') is in fluid communication with the second opening of the fourth control valve (392*a*) and of the tenth control valve (393*a*), and the second chamber (330B) is in fluid communication with the second end of the sixth control valve (395*a*).

7. An air conditioning system, comprising an expansion unit used for adiabatically expanding refrigerant, an indoor unit having a heat exchanger, a compressor used for adiabatically compressing the refrigerant, and an outdoor unit having a heat exchanger, and sequentially circulating the refrigerant through the compressor, outdoor unit, expansion unit, and indoor unit to heat or cool a target area using a phase change of the refrigerant, wherein condensed refrigerant from the indoor unit or the outdoor unit passes through a heat exchanging, sub-evaporating unit prior to flowing into the expansion unit, with the refrigerant from the sub-evaporating unit partially flowing into a sub-expansion unit to be adiabatically expanded to become low temperature, low pressure bypassed refrigerant, and both the bypassed refrigerant flowing from the sub-expansion unit and the refrigerant flowing from the outdoor unit or the indoor unit and passing through the expansion unit commonly passing through the sub-evaporating unit prior to flowing into the compressor, wherein the heat exchanging, sub-evaporating unit includes a first heat exchanging, sub-evaporating unit (450) having a heat exchanger (452) mounted in a housing (451) and a second heat exchanging, sub-evaporating unit (460) having a heat exchanger (462) mounted in a housing (461), the expansion unit (410) has a first opening in fluid communication with first opening of the heat exchanger (452) of the first heat exchanging, sub-evaporating unit (450) and has a second opening in fluid communication with first opening of the heat exchanger (462) of the second heat exchanging, sub-evaporating unit (460);

a first sub-expansion unit (471) having a first opening in fluid communication with first opening of a first control valve (455*a*), with second opening of the first flow control valve (455*a*) in fluid communication with the first opening of the expansion unit (410) and the first opening of the heat exchanger (452) of the first sub-evaporation unit (450), second opening of the first sub-expansion unit (471) is in fluid communication with the housing (451) of the first sub-evaporation unit (450);

a second sub-expansion unit (472) having a first opening in fluid communication with first opening of a second flow control valve (465*a*), with second opening of the second flow control valve (465*a*) in fluid communication with the second opening of the expansion unit (410) and the first opening of the heat exchanger (462) of the second heat exchanging, sub-evaporating unit (460), with second opening of the second sub-expansion unit (472) in fluid communication with the housing (461) of the second heat exchanging, sub-evaporating unit (460);

second opening of the heat exchanger (452) of the first heat exchanging, sub-evaporating unit (450) in fluid communication with the outdoor unit (440);

second opening of the heat exchanger (462) of the second heat exchanging, sub-evaporating unit (460) is in fluid communication with the indoor unit (420);

the housing (451) of the first heat exchanging, sub-evaporating unit (450) in fluid communication with first opening of a third flow control valve (457*a*) and in fluid communication with first opening of a fourth flow control valve (456*a*), second opening of the third valve (457*a*) in fluid communication with first opening of the compressor (430) and first opening of fifth flow control valve (467*a*), with second opening of the fifth control valve in fluid communication with the housing (461) of the second heat exchanging, sub-evaporating unit (460);

the housing of the expansion unit (410) at a first location is in fluid communication with second opening of the fourth control valve (456*a*) and first opening of sixth flow control valve (492*a*) and at a second location in fluid communication with first opening of a seventh flow control valve (466*a*) and first opening of eighth flow control valve (493*a*), with second opening of the seventh control valve (466*a*) in fluid communication with the housing (461) of the second heat exchanging, sub-evaporating unit (460);

second opening of the eighth control valve (493*a*) in fluid communication with the indoor unit (420) and first opening of ninth flow control valve 496*a*); and second opening of the ninth control valve (496*a*) in fluid communication with the compressor (430) and first opening of tenth flow control valve (495*a*), with second opening of the tenth control valve (494*a*) in fluid communication with the outdoor unit (440) and second opening of the sixth control valve (492*a*), wherein when the system is in the cooling mode the first valve (455*a*), the third valve (457*a*), the fourth valve (456*a*), the eighth valve (493*a*), and the tenth valve (495*a*) are in an open position to pass refrigerant therethrough and the second valve (465*a*), the fifth valve (467*a*), the sixth valve (492*a*), the seventh valve (466*a*), and the ninth valve (496*a*) are in the closed position to stop refrigerant from moving therethrough, and when the system is in the heating mode the second valve (465*a*), the fifth valve (467*a*), the sixth valve (492*a*), the seventh valve (466*a*), and the ninth valve (496*a*) are in the open position to pass refrigerant therethrough, and the first valve (455*a*), the third valve (457*a*), the fourth valve (456*a*), the eighth valve (493*a*), and the ten valve (495*a*) are in the closed position to stop refrigerant from moving therethrough.

8. The air conditioning unit according to claim 7, wherein the first heat exchanging, sub-evaporating unit (450, now designated 450') includes a first heat exchanger unit (450A) and a second heat exchanger unit (450B), the second heat exchanging, sub-evaporating unit (460, now designated 460') includes a first heat exchanger unit (460A) and a second heat exchanger unit (460B), the expansion unit (410, now designated 410') includes a first sub unit (410A) and a second sub unit (410B), the first sub-expansion unit (471, now designated 471') includes a first sub unit (471A) and a second sub unit (471B), and the second sub-expansion unit (472, now designated 472') includes a first sub unit (472A) and a second sub unit (472B), and the compressor (430, now designated 431') includes a first chamber (430A) and a second chamber (430B), wherein the first opening of the first control valve (455*a*) is in fluid communication with first opening of the second sub unit (471B) of the first sub-expansion unit (471') and second opening of the second sub unit (471A) of the first sub-expansion unit (471') is in fluid communication with first opening of the first sub unit (471A) of the first sub-expansion unit (471');

the second opening of the first valve (455*a*) is in fluid communication with first opening of the second heat exchanger unit (450B) of the first heat exchanging, sub-evaporating unit (450) and first opening of the first sub-expansion unit (410A) of the expansion unit (410');

second opening of the second heat exchanger unit (450B) of the first heat exchanging, sub-evaporating unit (450) is in fluid communication with first opening of the first heat exchanger unit (450A of the first heat exchanging, sub-evaporating unit (450), and second opening of the first heat exchanger unit (450A) of the first heat exchanging, sub-evaporating unit (450) is in fluid communication with the outdoor unit (440);

second opening of the first sub unit (471A) of the first sub-expansion unit (471') is in fluid communication with housing of the second heat exchanger unit (340B) of the first heat exchanging, sub-evaporating unit (340');

housing of the first heat exchanger unit (450A) of the first heat exchanging, sub-evaporating unit (450') is in fluid communication with the first opening of the third valve (457*a*), and housing of the second heat exchanger unit (450B) of the first heat exchanging, sub-evaporating unit (450') is in fluid communication with the first opening of the fourth control valve (456*a*);

second opening of the first sub unit (410A) of the expansion unit (410') is in fluid communication with first opening of the second sub unit (410B) of the expansion unit (410), second opening of the second sub unit (410B) of the expansion unit (410') is in fluid communication with the second opening of the second valve (465*a*) and first opening of the first heat exchanger unit (460A) of the second heat exchanging, sub-evaporating unit (460');

the first opening of the second valve (465*a*) is in fluid communication with first opening of the first sub unit (472A) of the second sub-expansion unit (472'), and second opening of the first sub unit (472A) of the second sub-expansion unit (472') is in fluid communication with the first opening of the second sub unit (472B) of the second sub-expansion unit (472'), second opening of the second sub unit (472B) of the second sub-expansion unit (472') is in fluid communication with housing of the first heat exchanger unit (460A) of the second heat exchanging, sub-evaporating unit (460');

second opening of the first heat exchanger unit (460A) of the second heat exchanging, sub-evaporating unit (460') is in fluid communication with the first opening of the second heat exchanger unit (460B) of the second heat exchanging, sub-evaporating unit (460'), second opening of the second heat exchanger unit (460B) of the second heat exchanging, sub-evaporating unit (460') is in fluid communication with the indoor unit (420);

the second opening of the fifth valve (467*a*) is in fluid communication with the housing of the second heat exchanger unit (460B) of the second heat exchanging, sub-evaporating unit (460'), an the second opening of the seventh valve is in fluid communication with the housing of the first heat exchanger unit (460A) of the second heat exchanging, sub-evaporating unit (460');

the first opening of the seventh valve (466*a*) and of the eighth valve (493*a*) are in fluid communication with the housing of the second sub-expansion unit (410B) of the expansion unit (410') and the first opening of the sixth control valve (492*a*) and the second opening of the fourth control valve (456*a*) are in fluid communication with the housing of the first sub unit (410A) of the expansion unit (410'); and the first chamber (430A) of the compressor (430) in fluid communication with the second opening of the fourth and fifth control valves (457*a* and 467*a*), and the second chamber (430B) of the compressor (430') is in fluid communication with the second opening of the ninth control valve (496*a*) and the first opening of the tenth control valve (495*a*).

* * * * *

UNITED STATES PATENT AND TRADEMARK OFFICE

CERTIFICATE OF CORRECTION

PATENT NO. : 6,640,567 B2
DATED : November 4, 2003
INVENTOR(S) : Young Ho Kim et al.

It is certified that error appears in the above-identified patent and that said Letters Patent is hereby corrected as shown below:

Title page,
Item [73], Assignee, "Gelm" should read -- Geum --.

Column 9,
Line 4, "provide" should read -- provided --.
Line 54, "port" should read -- ports --.

Column 14,
Lines 17 and 27, "pipes" should read -- pipe --.

Column 15,
Line 25, "port" should read -- ports --.

Column 16,
Line 21, "refrigerant selected" should read -- refrigerant to selected --.

Column 17,
Line 42, "0ºC. 10ºC." should read -- 0ºC. ~ 10ºC. --.

Column 26,
Line 49, "rind flows" should read -- and flows --.

Column 27,
Line 54, "having heat" should read -- having a heat --.

Column 28,
Line 28, "first opening of sixth" should read -- first opening of a sixth --.
Line 56, "heating mod" should read -- heating mode --.

Column 29,
Line 45, "expansion unit (110)" should read -- expansion unit (110') --.

Column 30,
Line 55, "first opening of second" should read -- first opening of a second --.

Column 31,
Line 58, "(171')" should read -- (271') --.
Line 60, "(271)" should read -- (271') --.

UNITED STATES PATENT AND TRADEMARK OFFICE

CERTIFICATE OF CORRECTION

PATENT NO. : 6,640,567 B2
DATED : November 4, 2003
INVENTOR(S) : Young Ho Kim et al.

It is certified that error appears in the above-identified patent and that said Letters Patent is hereby corrected as shown below:

Column 32,
Line 61, "(130B)" should read -- (230B) --.

Column 33,
Line 57, "(92a)" should read -- (392a) --.

Column 35,
Line 7, "is n fluid" should read -- is in fluid --.

Column 37,
Line 6, "valve 496a)" should read -- valve (496a) --.
Line 43, "designated 431')" should read -- designated 430') --
Line 55, "(450)" should read -- (450') --.

Column 37,
Lines 58 and 61, "(450)" should read -- (450') --.
Line 60, (450A of" should read -- (450A) of --.

Column 38,
Line 1, "(340B)" should read -- (450B) --.
Line 3, "(340')" should read -- (450') --.
Line 15, "(410)" should read -- (410') --.
Line 46, "an the" should read -- and the --.
Line 58, "(430)" should read -- (430') --.

Signed and Sealed this

Twentieth Day of April, 2004

JON W. DUDAS
*Acting Director of the United States Patent and Trademark Office*